US007162955B2

(12) United States Patent
Naniwa et al.

(10) Patent No.: US 7,162,955 B2
(45) Date of Patent: Jan. 16, 2007

(54) LITHOGRAPHIC PRINTING METHOD AND PRINTING PRESS

(75) Inventors: Mutsumi Naniwa, Shizuoka (JP); Toshifumi Inno, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 111 days.

(21) Appl. No.: 10/800,857

(22) Filed: Mar. 16, 2004

(65) Prior Publication Data

US 2004/0187720 A1 Sep. 30, 2004

(30) Foreign Application Priority Data

Mar. 24, 2003 (JP) ..... 2003-080103

(51) Int. Cl.
*B41M 1/06* (2006.01)

(52) U.S. Cl. ..... 101/450.1

(58) Field of Classification Search ..... 101/450.1
See application file for complete search history.

(56) References Cited

U.S. PATENT DOCUMENTS 3,467,008 A * 9/1969 Domotor ..... 101/142
4,724,764 A * 2/1988 MacPhee et al. ..... 101/451
4,991,502 A * 2/1991 Akao ..... 101/148
5,562,031 A 10/1996 Garner et al.

FOREIGN PATENT DOCUMENTS

EP 0 770 494 A2 5/1997
JP 2000-052634 A 2/2000

* cited by examiner

*Primary Examiner*—Andrew H. Hirshfeld
*Assistant Examiner*—Joshua Zimmerman
(74) *Attorney, Agent, or Firm*—Birch, Stewart, Kolasch & Birch, LLP

(57) ABSTRACT

Disclosed is a method of carrying out lithographic printing using a plate having an image recording layer capable of being developed with dampening water and/or ink, the method including:

a development step in which a plate bearing a recorded image, mounted on a plate cylinder and having a given surface speed is subjected to contact with a dampening roller and/or a form roller having a surface speed differing from the surface speed of the plate, and is thereby supplied with dampening water and/or ink; and a printing step in which ink is transferred to a printing material while the dampening roller and form roller remain in contact with the plate.

The method of the present invention is a lithographic printing method which uses on-machine development type plates and has a very high productivity because the amount of paper spoilage at the start of printing is low and the time until scum-free impressions are obtained is short.

3 Claims, 3 Drawing Sheets

LITHOGRAPHIC PRINTING METHOD AND PRINTING PRESS

This Nonprovisional application claims priority under 35 U.S.C. § 119(a) on Patent Application No(s) . 2003-080103 filed in JAPAN on Mar. 24, 2003, the entire contents of which are hereby incorporated by reference.

BACKGROUND OF THE INVENTION

1. Field of the Invention

The present invention relates to a lithographic printing method and a printing press which use on-machine development type plates. More specifically, the present invention relates to a lithographic printing method which has very little paper spoilage at the start of printing and a short prep time, and thus has a very high productivity. The invention relates also to a printing press that is well-suited for use in such a method.

2. Description of the Related Art

By employing printing plates capable of being developed on the printing press with dampening water and/or ink, typically referred to as "on-machine development type plates," as a way to improve the productivity of lithographic printing, it has been possible to dispense with a development step in which a developer is used, thereby shortening the platemaking time. Moreover, eliminating the need for a processing machine and developer has a number of advantages, such as lowering costs.

However, the use of a method in which an on-machine development type plate is employed and in which development is carried out with dampening water and/or ink (see, for example, JP 2000-52634 A: the term "JP XX-XXXXXX A" as used herein means an "unexamined published Japanese patent application") has the following drawbacks.

For example, with on-machine development type plates of the sort from which non-image areas of the image recording layer are removed, after the image has been recorded, the image recording layer in non-image areas is removed with dampening water and/or ink, leaving the hydrophilic surface of the plate exposed. Yet, instead of being completely removed, residues of the image recording layer sometimes continue to adhere to the plate surface in non-image areas.

Because these portions of the image recording layer that continue to adhere instead of being removed are oleophilic, ink deposits thereon, contaminating the non-image areas. As printing proceeds, such residues are removed by the dampening water and thus cease to contaminate. The paper which is used until scum ceases following the start of printing is generally referred to as "spoilage." During this period, scum-free impressions cannot be obtained.

SUMMARY OF THE INVENTION

A desire thus exists to achieve a higher printing productivity using on-machine development type plates by reducing the amount of paper spoilage at the start of printing and by lowering the time until scum-free impressions are obtained.

It is therefore one object of the present invention to provide a lithographic printing method which uses on-machine development type plates and has a very high productivity because the amount of paper spoilage at the start of printing is low and the time until scum-free impressions are obtained is short. Another object of the present invention is to provide a printing press which is highly suitable for use in such a method.

After extensively studying lithographic printing methods which use on-machine development type plates to achieve the objects, the present inventors have found that the amount of paper spoilage at the start of printing can be reduced and the time required to obtain scum-free impressions can be shortened if, when the dampening roller and/or the form roller in the printing press is contacted with a plate bearing a recorded image and mounted on a plate cylinder to feed dampening water and/or ink to the plate, a speed difference is imparted between the plate and the dampening roller and/or form roller so as to abrade the surface of the plate.

Accordingly, the present invention provides the following lithographic printing method (1) to (4) and printing press (5).

(1) A method of carrying out lithographic printing using a plate having an image recording layer capable of being developed with dampening water and/or ink, the method including:

a development step in which a plate bearing a recorded image, mounted on a plate cylinder and having a given surface speed is subjected to contact with a dampening roller and/or a form roller having a surface speed differing from the surface speed of the plate, and is thereby supplied with dampening water and/or ink; and a printing step in which ink is transferred to a printing material while the dampening roller and form roller remain in contact with the plate.

(2) The lithographic printing method according to (1) above, wherein the dampening roller has different speeds in the development step and the printing step.

(3) The lithographic printing method according to (1) or (2) above, wherein the form roller has different speeds in the development step and the printing step.

(4) The lithographic printing method according to any one of (1) to (3) above, wherein the image recording layer contains at least one hydrophobization precursor and at least one photothermal conversion substance.

(5) A printing press that has a dampening roller, a form roller and a plate cylinder and that carries out lithographic printing using a plate having an image recording layer capable of being developed with dampening water and/or ink, the printing press includes:

a developing device for carrying out development by bringing the dampening roller and/or form roller into contact with a plate on which an image has been recorded and which is mounted on the plate cylinder, and supplying dampening water and/or ink to the plate;

a printing device for transferring ink to a printing material while the dampening roller and form roller remain in contact with the plate; and a roller speed control device for controlling the surface speed of the dampening roller and/or form roller in development step so that it differs from the surface speed of the plate mounted on the plate cylinder.

In the above lithographic printing method (1), the surface speed of the dampening roller and/or form roller in the development step differs from the surface speed of the plate, enabling non-image areas of the image recording layer to be easily removed by a rubbing action. As a result, either non-image areas incur no scum whatsoever after the start of printing, or the scum of non-image areas can be eliminated in a very short period of time.

Accordingly, paper spoilage at the start of printing can be reduced and the prep time shortened, enabling the productivity of printing using on-machine development type plates to be further improved.

Moreover, because the lithographic printing method (1) above provides excellent developability, in high-precision printing, very small surface areas, including in particular non-image areas in shadows, can be reliably developed, enabling high-quality impressions to be obtained.

This good developability also means that development is possible even when the dose of energy received at the plate surface during imagewise exposure is lower than in the prior art. Thus, for example, it is possible to increase the exposure speed when an image is recorded, and thereby shorten the image recording time, enabling even further improvement in productivity.

In addition, such good developability enables development to be carried out in an image recording time comparable with that in the prior art, even when use is made of a light source having a lower output than light sources used in the prior art. Given the generally high cost of light sources for image recording, very significant reductions in the cost of the exposure system can be achieved by employing a light source having a lower output level.

In the lithographic printing methods of (2) and (3) above, the dampening roller and/or form roller have different speeds in the development step and the printing step. As a result, the developability can be enhanced by imparting optimal roller speeds in the development step. In addition, a good printing performance, particularly a long press life, can be achieved by imparting optimal roller speeds in the printing step.

In the lithographic printing method of (4) above, the plate used has an excellent developability, thus providing a particularly outstanding productivity.

The printing press of (5) above is well suited for use in the lithographic printing methods of (2) and (3) above.

The lithographic printing method of the present invention, owing to its low paper spoilage at the start of printing and the short time required until scum-free impressions are obtained, provides an excellent productivity. Moreover, high-quality impressions can be obtained in high-precision printing. The lithographic printing method of the present invention is thus very useful. In addition, the printing press of the present invention is well-suited for use in the lithographic printing method of the present invention, and thus highly beneficial.

DETAILED DESCRIPTION

The lithographic printing method and the printing press of the present invention are described more fully below based on the preferred embodiments shown in the attached drawings.

Printing Press

First, the overall construction of a printing press which can be used to carry out the lithographic printing method of the present invention is described.

Figure 1:
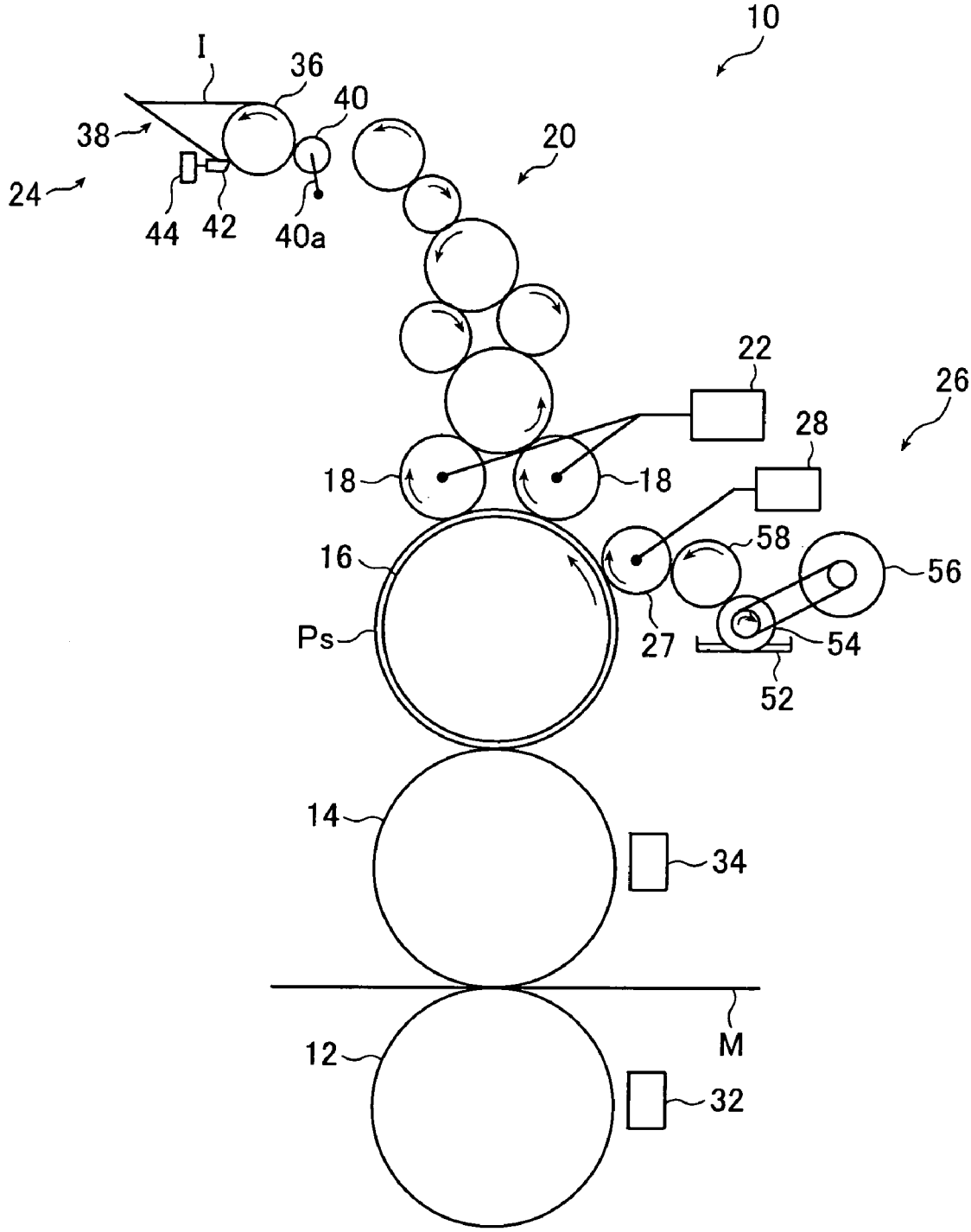
FIG. 1 is a schematic view showing an embodiment of a printing press according to the present invention which can be used to carry out the lithographic printing method of the present invention.

FIG. 1 is a schematic view showing an embodiment of a printing press which can be used to carry out the lithographic printing method of the present invention. The printing press 10 in FIG. 1 has an impression cylinder 12, a blanket cylinder (rubber cylinder) 14, a plate cylinder 16, form rollers 18, a series of ink rollers 20, a form roller speed controlling device 22 which controls the speed of the form rollers 18, an ink metering system 24, a dampening water feeding device 26 having a dampening roller 27, and a dampening roller speed controlling device 28 which controls the speed of the dampening roller 27.

In this printing press 10, first an on-machine development type plate Ps is mounted on the plate cylinder 16. The present example describes a plate Ps of a type which has an image recording layer that is developed with dampening water and from which the image recording layer in non-image areas is removed. However, the present invention is not limited to this particular type of plate.

The plate Ps may be one which is mounted following exposure, or the printing press 10 may be provided with an exposure system that exposes the plate Ps after it has been mounted on the plate cylinder 16.

Next, the dampening roller 27 comes into contact with the plate Ps, and the dampening water feeding device 26 supplies dampening water to the plate Ps. At this time, the surface speed of the dampening roller 27 is controlled by the dampening roller speed controlling device 28 so as to differ from the surface speed of the plate Ps. As a result, the non-image areas of the image recording layer are subjected to development by the dissolving and/or dispersing action of the dampening water itself and also by a rubbing action. This constitutes the development step.

Ink is subsequently fed to the plate Ps by a process in which the ink metering system 24 transfers ink to the ink rollers 20, which then transfer the ink to the form rollers 18, which in turn transfer the ink to the plate Ps held on the plate cylinder 16. In this way, ink gradually adheres to the image areas of the image recording layer of the plate Ps.

The surface speed of the form roller 18 is controlled by the form roller speed controlling device 22 so as to differ from the surface speed of the plate Ps, and the development of non-image areas of the image recording layer proceeds further under the consequent rubbing action, resulting in the removal of debris from the developed image recording layer (development debris). Areas where the image recording layer has been removed, leaving the hydrophilic surface exposed, become covered with the dampening water, as a result of which ink does not adhere. Thus, ink adherence (scum) in non-image areas of the plate Ps diminishes over time.

As above described, in the development step in this example, development is basically carried out by the dissolving action of the dampening water itself and the rubbing action by the dampening roller, although the rubbing action by the form roller also helps development to proceed.

In the lithographic printing method of the present invention, it is enough for at least one of the dampening roller and the form roller, which is in contact with the plate during development, to have a surface speed that differs from the surface speed of the plate.

Next, in the printing step, a printing material M (e.g., printing paper) is fed while the dampening roller and form roller remain in contact with the plate, and ink is transferred to the printing material M. The transfer of ink to the printing material M is effected by the transfer of ink on the plate Ps to the blanket cylinder 14, followed by transfer of the ink on the blanket cylinder 14 to a printing material M which is conveyed while being gripped by the blanket cylinder 14 and the impression cylinder 12.

At substantially the same time that the printing material M is being fed, the surface speeds of the dampening roller 27 and the form roller 18 are respectively controlled by a dampening roller speed controlling device 28 and a form roller speed controlling device 22 so as to be substantially the same as the surface speed of the plate Ps.

In this way, the dampening water and ink are fed to the plate Ps on which an image has been recorded. At the same time, ink on the plate Ps is transferred to the printing material M, in the course of which non-image areas on the image recording layer of the plate Ps are completely removed. That is, the plate Ps is completely developed, becoming a printing plate, and the ink, which has adhered only to image areas of the printing plate, is transferred to the printing material M, giving impressions that are free of scum in non-image areas.

A method of on-machine development has been described in which first dampening-water is supplied to the plate Ps, following which ink is supplied. However, on-machine development is carried out in accordance with the type of image recording layer of the plate. For example, use can also be made of a method in which dampening water and ink are supplied at the same time, a method in which first ink is supplied then dampening water is supplied, or a method in which an emulsion of dampening water and ink is supplied.

In FIG. 1, an example of a single-color printing press 10 is shown for purposes of clarity in explaining the construction of the apparatus. However, the present invention is not limited to a single-color printing press, and may be practiced using printing presses capable of any of various types of multicolor printing, including presses having a construction adapted for full color printing with four colors.

The various elements of the printing press are described more fully below.

In the printing press 10, the impression cylinder 12 and the blanket cylinder 14 are the same as in a conventional printing press for offset printing. A known impression cylinder washing unit 32 is positioned at the impression cylinder 12, and a known blanket washing unit 34 is positioned at the blanket cylinder 14.

The ink metering system 24 has an ink fountain roller 36, a known ink fountain I which consists of an ink key 42 abutting the ink fountain roller 36 and a blade 38 abutting the ink key 42, an ink doctor 40, and a motor 44 for driving the ink key 42.

The ink fountain roller 36 draws a film of ink having a given thickness (that is, the ink is metered) from ink fountain I, and moves the ink to the ink doctor 40, which is in contact with the ink fountain roller 36 and rotates.

In the illustrated ink metering system 24, the film thickness (feed rate) of the ink drawn out by the ink fountain roller 36 is adjusted by regulating the interval or pressing force between a leading edge of the ink key 42 and the ink fountain roller 36. A plurality of ink keys 42 are closely arrayed in the direction of the rotational axis (width direction) of the ink fountain roller 36, the interval between each ink key 42 and the ink fountain roller 36 being adjusted by the motor 44.

In the present invention, the ink metering device is not limited to the above-described ink metering system 24. Use can instead be made of known metering device such as a system that employs an anilox roller and a doctor blade; a system composed of an ink fountain roller and a roller which is positioned so as to be separated from the ink fountain roller and the separation interval and rotational speed of which are adjustable, with the space between the two rollers serving as the ink fountain; and a system composed of an ink fountain roller and a roller which is positioned so as to be in direct contact with the ink fountain roller and the contacting pressure and rotational speed of which are adjustable, with the space between the two rollers serving as the ink fountain.

The ink doctor 40 is a driven roller having a rotating shaft which is rotatably supported by an arm 40*a*. The arm 40*a* is supported in a freely turning manner at an end opposite to the ink doctor 40 and turns under a driving source (not shown). When the arm 40*a* is turned, the ink doctor 40 comes into contact with the ink fountain roller 36 and has ink transferred thereto. The ink doctor 40 then moves to the side of the ink rollers 20 and comes into contact with the lead ink roller, to which it transfers ink. This action is repeatedly carried out in accordance with a predetermined period or operating information.

The series of ink rollers 20 is not subject to any particular limitation and may have any suitable known arrangement, although it generally includes an ink distributing roller, an ink distributing cylinder, an intermediate roller and a vibrating roller. Ink that has been transferred to the lead roller in the series of ink rollers 20 is then transferred between each roller in the series, during which time it is worked and rendered uniform. The ink is then transferred to the form rollers 18.

The dampening water feeding device 26 may be one that is known to the prior art. In the illustrated example, the dampening water feeding device 26 includes a water fountain 52, a water fountain roller 54, a motor 56, a vibrating roller 58 and a dampening roller 27.

In this dampening water feeding device 26, the motor 56 adjusts the rotational speed of the water fountain roller 54, thereby regulating the amount of dampening water supplied from the water fountain 52 and regulating the feed rate of the dampening water supplied from the dampening roller 27 to the plate surface.

The vibrating roller 58 moves in the direction of the rotational axis, thereby adjusting the amount of water in the width direction of the dampening roller 27.

The plate cylinder 16 is provided with a device for mounting the plate Ps thereon. The plate mounting device may be any of various such device utilized in prior-art printing presses. Alternatively, a plate supply and removal apparatus (not shown) which is composed of a plate Ps supplying unit and a used printing plate removing unit may be provided. Operations such as supplying the plate to the plate cylinder, mounting the plate on the plate cylinder, and removing the used printing plate from the plate cylinder may be carried out by known methods.

The present invention is described more closely below. Because the actions of the dampening roller and the form rollers in the present invention are substantially the same, such actions are described in detail only for the dampening roller but are accompanied in the text by references in parentheses to the form rollers or actions relating thereto.

In the present invention, the dampening roller (the form rollers) in the development step has a surface speed which differs from the surface speed of the plate. It is also advantageous to have the speed of the dampening roller (form rollers) in the development step which differs from the speed of the dampening roller (form rollers) in the printing step.

For example, the speed of the dampening roller 27 (form rollers 18) may be controlled by a dampening roller speed controlling device 28 (form roller speed controlling device 22). Typically, the dampening roller speed controlling device 28 (form roller speed controlling device 22) changes the speed of the dampening roller 27 (form rollers 18) after receiving a signal, such as a start printing signal (start paper feed signal).

In this case, the speed of the dampening roller 27 (form rollers 18) may be changed to a single preset value, may be changed in a stepwise fashion to a sequence of preset values, or may be continuously changed.

In one preferred embodiment of the present invention, the speed of the dampening roller 27 (form rollers 18) is changed as described above in the development step and the printing step. The change in speed may be timed to occur substantially simultaneous with the start of printing (the start of paper feed), or may be timed to occur anywhere from several seconds to several tens of seconds thereafter. This timing may be varied according to such factors as the speed of the printing press, although it is desirable for the speed of the dampening roller 27 (form rollers 18) to be changed within a period of preferably from 30 seconds before the start of printing to 10 seconds after the start of printing more preferably from 20 seconds before the start of printing to 5 seconds after the start of printing, and still more preferably from 10 seconds before the starting of printing to 3 seconds after the start of printing. The length of time devoted to changing the speed of the dampening roller 27 (form rollers 18) may be set to any suitable value. For example, the change in speed may be substantially instantaneous or may be effected over a period of several seconds. Alternatively, the change in speed of the dampening roller 27 (form rollers 18) may be effected in a stepwise or continuous manner.

In cases where the dampening roller 27 (form rollers 18) is controlled by sending signals to the dampening roller speed controlling device 28 (form roller speed controlling device 22), either the operator may check visually or by some other devices that paper feed has begun, then send such a signal to the dampening roller speed controlling device 28 (form roller speed controlling device 22), or an arrangement may be made for signals to be sent to the dampening roller speed controlling device 28 (form roller speed controlling device 22) in a manner that is coupled with operation of, for example, the paper feeder (not shown) on the printing press 20.

The method employed to change the speed of the dampening roller 27 (form rollers 18) is not subject to any particular limitation, and may be suitably selected according such considerations as the characteristics of the plate being used.

Preferred examples include the following.

(a) A method where the speed of the dampening roller 27 (form rollers 18) is controlled in the respective steps such that, in the development step, the dampening roller 27 (form rollers 18) has a slower surface speed than the plate and, in the printing step, the dampening roller 27 (form rollers 18) has about the same surface speed as the plate.

(b) A method where the speed of the dampening roller 27 (form rollers 18) is controlled in the respective steps such that, in the development step, the dampening roller 27 (form rollers 18) has a faster surface speed than the plate and, in the printing step, the dampening roller 27 (form rollers 18) has about the same surface speed as the plate.

Figure 2A:
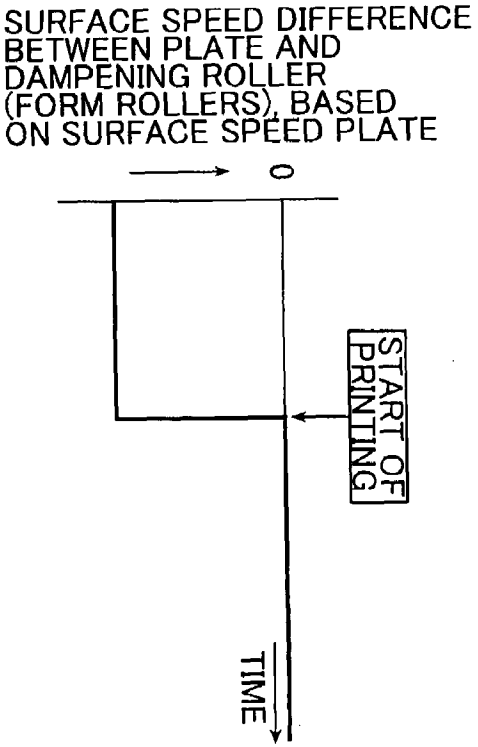
FIG. 2 shows graphs of the roller surface speed difference with respect to the plate versus the print starting time in specific examples of the lithographic printing method of the present invention.
Figure 2B:
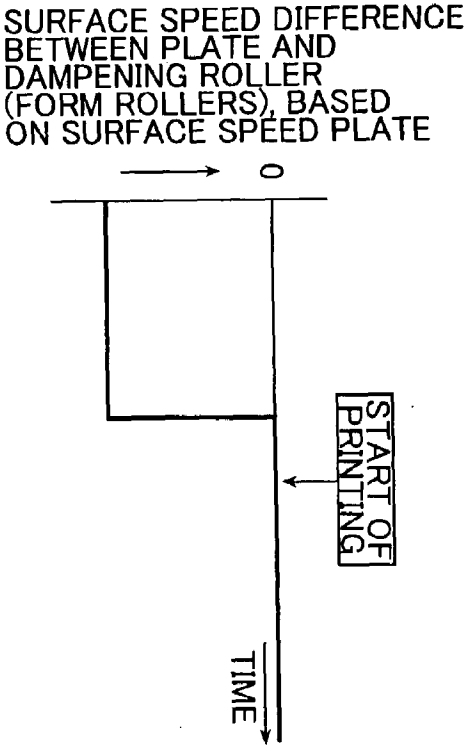
Figure 2C:
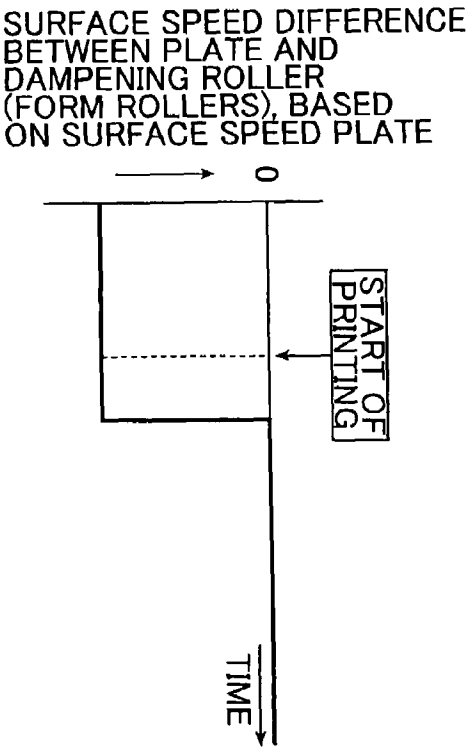

FIG. 2 shows specific examples of the roller surface speed difference with respect to the plate versus the print starting time in above method (a). That is, FIG. 2A shows a case in which the speed of the dampening roller 27 (form rollers 18) is changed simultaneous with the start of printing, FIG. 2B shows a case in which the speed of the dampening roller 27 (form rollers 18) is changed just before the start of printing, and FIG. 2C shows a case in which the speed of the dampening roller 27 (form rollers 18) is changed just after the start of printing.

Figure 3A:
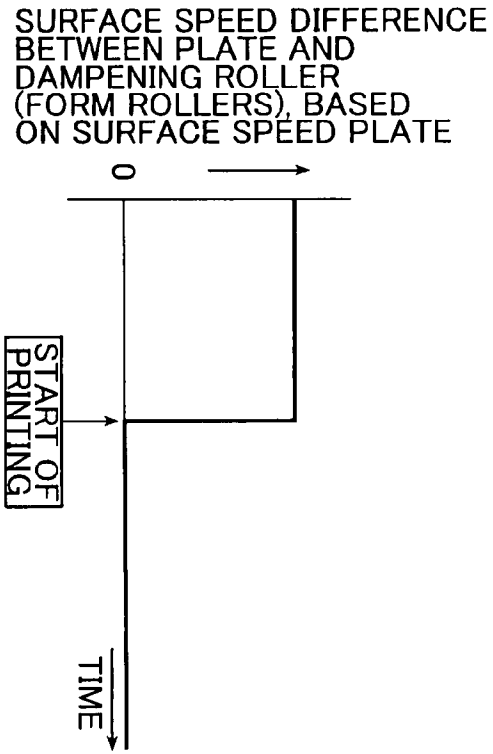
FIG. 3 shows graphs of the surface speed difference with respect to the plate versus the print starting time in other specific examples of the lithographic printing method of the present invention.
Figure 3B:
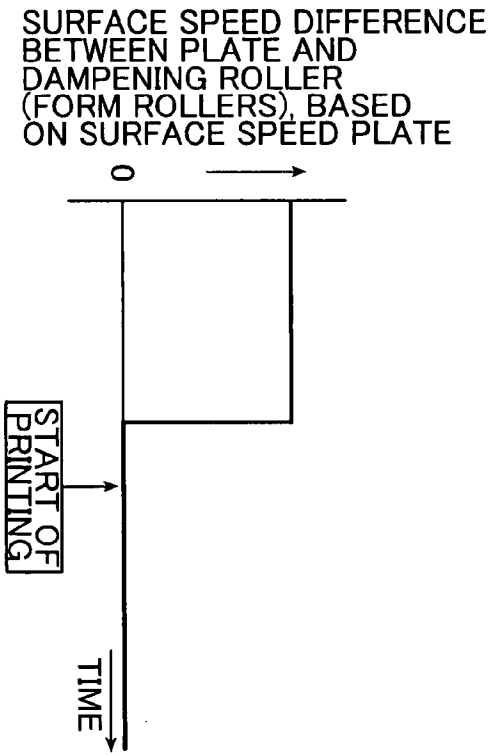
Figure 3C:
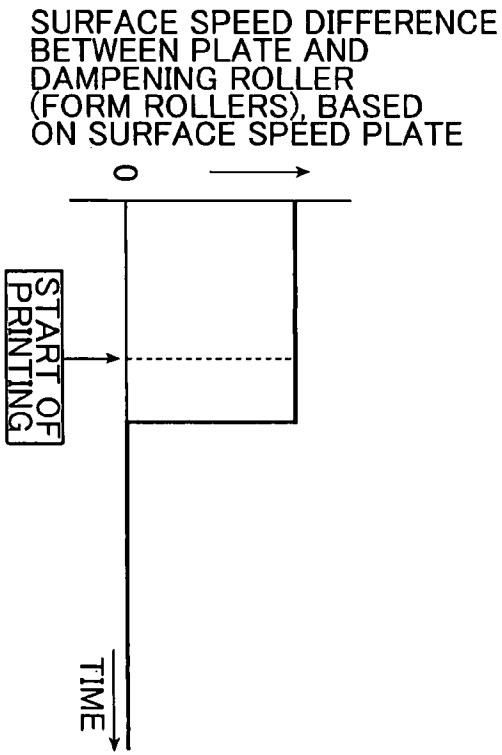

FIG. 3 shows specific examples of the surface speed difference with respect to the plate versus the print starting time in above method (b). That is, FIG. 3A shows a case in which the speed of the dampening roller 27 (form rollers 18) is changed simultaneous with the start of printing, FIG. 3B shows a case in which the speed of the dampening roller 27 (form rollers 18) is changed just after the start of printing, and FIG. 3C shows a case in which the speed of the dampening roller 27 (form rollers 18) is changed just before the start of printing.

In above methods (a) and (b), the surface speed of the dampening roller 27 (form rollers 18) in the development step differs from the surface speed of the plate, creating a rubbing action which enables non-image areas of the image recording layer to be easily removed. Accordingly, either no scum whatsoever of the non-image areas occurs after the start of printing, or the scum of non-image areas can be eliminated in a very short period of time. Therefore, paper spoilage at the start of printing can be reduced and the prep time can be shortened, making it possible to further increase printing productivity using on-machine development type plates.

In above methods (a) and (b), by having the speed of the dampening roller 27 (form rollers 18) in the development step and the speed of the dampening roller 27 (form rollers 18) mutually differ and by making the surface speed of the dampening roller 27 (form rollers 18) in the printing step substantially the same as the surface speed of the plate, the surface of the plate is not damaged, enabling a long press life to be achieved.

In above method (a) or (b), it is also possible to have the speed of the dampening roller 27 (form rollers 18) in the development step vary in a series of steps or vary continuously.

In the development step, preferred use can be made of the following methods.

(c) A method where the speed of the dampening roller 27 (form rollers 18) is controlled so that first the surface speed of the dampening roller 27 (form rollers 18) is slower than the surface speed of the plate, then the surface speed of the dampening roller 27 (form roller 18) is faster than the surface speed of the plate.

(d) A method where the speed of the dampening roller 27 (form rollers 18) is controlled so that first the surface speed of the dampening roller 27 (form rollers 18) is faster than the surface speed of the plate, then the surface speed of the dampening roller 27 (form roller 18) is slower than the surface speed of the plate.

In the development step, when the difference between the surface speed of the plate and the surface speed of the dampening roller 27 (form rollers 18) is small, the developability is low. On the other hand, when this difference is large, the plate surface is damaged, shortening the press life of the plate. Therefore, taking into consideration both the developability and the press life, the surface speed difference is set to a value, which is based on the surface speed of the plate and which is positive when the dampening roller 27 (form roller 18) has a higher surface speed than the plate, within a range of preferably −2 to −50% and 2 to 50%, more preferably −5 to −30% and 5 to 30%, and still more preferably −10 to −20% and 10 to 20%.

Also, as noted above, in the printing step, it is preferable for the surface speed of the dampening roller 27 (form roller 18) to be substantially the same as the surface speed of the plate.

Therefore, in cases where the printing speed (surface speed of the plate) changes (e.g., increases) after the start of printing, it is desirable to change the speed of the dampening roller 27 (form rollers 18) in accordance therewith.

Preferred examples of dampening roller speed controlling device 28 (form roller speed controlling device 22) that may be used in the printing press 10 of the present invention are given below.

(i) A device having a motor (not shown) which drives the dampening roller 27 (form rollers 18) and having a motor controller (not shown) which controls the motor based on external signals (e.g., "start printing" signals). In the development step, the motor controller controls the motor so as to make the surface speed of the dampening roller (form rollers 18) differ from the surface speed of the plate. Next, when the motor controller receives the above signals, it controls the motor so as to make the surface speed of the dampening roller 27 (form rollers 18) substantially the same as the surface speed of the plate.

(ii) A device having a motor (not shown) which drives the dampening roller 27 (form rollers 18) and having a motor controller (not shown) which controls the motor based on external signals (e.g., "start printing" signals). In the development step, the motor controller controls the motor so as to make the surface speed of the dampening roller (form rollers 18) differ from the surface speed of the plate. Next, when the motor controller receives the above signals, it stops the supply of electricity to the motor so that the dampening roller 27 (form roller 18) becomes a driven roller. As a result, the dampening roller 27 (form rollers 18) is driven by the plate Ps on the plate cylinder 16, giving it substantially the same surface speed as the plate Ps.

(iii) A device having a motor (not shown) which drives the dampening roller 27 (form rollers 18), a motor controller (not shown) which controls the motor based on external signals (e.g., "start printing" signals), and a clutch between the motor and the dampening roller 27 (form rollers 18). In the development step, the motor controller controls the motor so as to make the surface speed of the dampening roller 27 (form rollers 18) differ from the surface speed of the plate. Next, when the motor controller receives the above signals, it cuts the clutch so that the dampening roller 27 (form roller 18) becomes a driven roller. As a result, the dampening roller 27 (form rollers 18) is driven by the plate Ps on the plate cylinder 16, giving it substantially the same surface speed as the plate Ps.

(iv) A device having a motor (not shown) which drives the vibrating roller 58 (ink rollers 20), and a motor controller (not shown) which controls the motor based on external signals (e.g., "start printing" signals), in which the dampening roller 27 (form rollers 18) is a driven roller. In the development step, the motor controller controls the motor so as to make the surface speed of the vibrating roller 58 (ink rollers 20) differ from the surface speed of the plate. Next, when the motor controller receives the above signals, it controls the motor so as to make the surface speed of the dampening roller 27 (form rollers 18) substantially the same as the surface speed of the plate.

In above device (iv), because the dampening roller 27 (form rollers 18) is a driven roller, in the development step it rotates at a surface speed which differs from those of both the plate Ps and the vibrating roller 58 (ink rollers 20), and in the printing step it rotates at substantially the same surface speed as the plate Ps.

The lithographic printing method and printing press of the present invention have been described above based on the preferred embodiments shown in the attached drawings. However, the present invention is not limited to these embodiments, and may be practiced using any variations, modifications and improvements thereof encompassed by the inventive ideas as set forth in the appended claims. For example, the arrangement of various elements may be substituted with any other suitable arrangement capable of exhibiting similar capabilities.

The type of plate Ps used in the foregoing description of preferred embodiments of the present invention is one in which the image recording layer in non-image areas is removed. However, the present invention is not limited in its application to this type of plate alone, and may also be suitably used on plates of a type in which a hydrophilic layer in image areas is removed. Suitable use can also be made of plates having an image recording layer which can be developed with ink, and plates having an image recording layer which can be developed with a combination of dampening water and ink.

Plate

Next, plates that may be employed in the lithographic printing method of the present invention are described. The plate used in the present invention is a plate having an image recording layer which can be developed on the press with dampening water and/or ink.

Support

The support used in the plate may be any dimensionally stable sheet or plate without particular limitation. Illustrative examples include paper, paper laminated with plastic (e.g., polyethylene, polypropylene, polystyrene), metal plate (e.g., aluminum, zinc, copper), plastic film (e.g., cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, polyvinyl acetal), and paper or plastic film on which the above metals have been laminated or vapor deposited. Preferred supports include polyester film and aluminum plate.

The aluminum plate may be a plate of pure aluminum, an alloy plate composed primarily of aluminum but containing small amounts of other elements, or a thin film of aluminum or aluminum alloy on which plastic is laminated. Other elements that may be present in the aluminum alloy include silicon, iron, manganese, copper, magnesium, chromium, zinc, bismuth, nickel and titanium. It is preferable for the content of other elements in the alloy to be not more than 10 wt %. The aluminum plate may be produced from an aluminum ingot obtained by a direct chill casting process or an ingot obtained by continuous casting. In the practice of the present invention, it is also possible to use aluminum plate that is a material known to the prior art.

The support has a thickness of preferably 0.05 to 0.6 mm, more preferably 0.1 to 0.4 mm, and most preferably 0.15 to 0.3 mm.

The aluminum plate, prior to being used, is preferably administered surface treatment such as graining treatment or anodizing treatment. Surface treatment improves the hydrophilic properties and makes it easy to ensure good adhesion between the image recording layer and the support.

Graining treatment of the aluminum plate surface may be carried out by various methods, such as mechanical graining, electrochemical graining (in which the surface is electrochemically dissolved) or chemical graining (in which the surface is selectively dissolved chemically).

A known method of mechanical graining may be used, such as ball graining, brush graining, blast finishing or buffing.

Preferred chemical graining methods include methods which involve immersion in a saturated aqueous solution of an aluminum salt of a mineral acid, like the method described in JP 54-31187 A.

Suitable methods for electrochemical graining include methods carried out with alternating current or direct current in an electrolytic solution containing an acid such as hydrochloric acid or nitric acid. Also suitable are methods which use mixed acids, like that described in JP 54-63902 A.

Graining treatment is preferably administered such as to impart to the surface of the aluminum plate a centerline average roughness ($R_a$) of 0.2 to 1.0 μm.

If necessary, the aluminum plate that has been grained is subjected to alkali etching treatment using an aqueous solution of, for example, potassium hydroxide or sodium hydroxide. In addition, the alkali etched plate, after it has been neutralized, may optionally be subjected to anodizing treatment to increase the wear resistance.

Various electrolytes capable of forming a porous oxide film may be used in anodizing treatment of the aluminum plate. Sulfuric acid, hydrochloric acid, oxalic acid, chromic acid or a mixture thereof is generally used. The concentrations of these electrolytes are set as appropriate for the type of electrolyte.

The anodizing treatment conditions vary empirically depending on the particular electrolyte used, although it is generally preferable for the electrolyte concentration in the solution to be 1 to 80 wt %, the solution temperature to be 5 to 70° C., the current density to be 5 to 60 A/dm$^2$, the voltage to be 1 to 100 V, and the period of electrolysis to be from 10 seconds to 5 minutes. The weight of the anodized layer that forms is preferably 1.0 to 5.0 g/m$^2$, and more preferably 1.5 to 4.0 g/m$^2$.

To further improve adhesion with the overlying layer, hydrophilic properties, resistance to scum, heat insulating properties and the like, suitable selection and use may be made of various treatments, including the followings mentioned in JP 2001-253181 A and JP 2001-322365 A: anodized layer micropore enlarging treatment, anodized layer micropore closing treatment, and surface hydrophilizing treatment imparted by immersion in an aqueous solution containing a hydrophilic compound.

Examples of preferred hydrophilic compounds for such hydrophilizing treatment include polyvinylphosphonic acid, compounds having sulfonic acid groups, carbohydrate compounds, citric acid, alkali metal silicates, zirconium potassium fluoride and phosphate/inorganic fluorine compounds.

If the support is one having a surface of insufficient hydrophilicity, such as a polyester film, it is preferable to provide a hydrophilic layer so as to render the surface hydrophilic. The hydrophilic layer is preferably one obtained by applying a coating fluid containing a colloid of an oxide or hydroxide of at least one element selected from the group consisting of beryllium, magnesium, aluminum, silicon, titanium, boron, germanium, tin, zirconium, iron, vanadium, antimony and transition metals, as described in JP 2001-199175 A. Of these, hydrophilic layers obtained by applying a coating fluid containing a colloid of silicon oxide or hydroxide is preferred.

Undercoat Layer

Before the image recording layer is applied onto the support, the support may have been applied thereto, if necessary, with an inorganic undercoat layer containing a water-soluble metal salt such as zinc borate or an organic undercoat layer containing, for example, carboxymethyl cellulose, dextrin or polyacrylic acid of the sort described in JP 2001-322365 A. This undercoat layer may have included therein the subsequently described photothermal conversion substance.

Image Recording Layer

Preferred examples of the plate used in the present invention include image recording layers containing a hydrophobic precursor. "Hydrophobic precursor," as used herein, refers to fine particles which, when heated, can alter the hydrophilic image recording layer to be hydrophobic. These fine particles are preferably of at least one type selected from the group consisting of thermoplastic polymer fine particles, thermally reactive polymer fine particles and microcapsules containing a hydrophobic compound.

Preferred examples of thermoplastic polymer fine particles include those described in Research Disclosure No. 33303 (January 1992), JP 9-123387 A, JP 9-131850 A, JP 9-171249 A, JP 9-171250 A and EP 931,647 A. Examples of polymers making up such thermoplastic polymer fine particles include homopolymers, copolymers and mixtures of such monomers as ethylene, styrene, vinyl chloride, methyl acrylate, ethyl acrylate, methyl methacrylate, ethyl methacrylate, vinylidene chloride, acrylonitrile, and vinyl carbazole. Of these, polystyrene and methyl polymethacrylate are preferred.

The thermoplastic polymer fine particles preferably have an average particle size of 0.01 to 2.0 μm.

Examples of methods that may be used to prepare the thermoplastic polymer fine particles include emulsion polymerization and suspension polymerization. Alternatively, a method may be used in which these compounds are dissolved in a non-water soluble organic solvent, the resulting solution is mixed with an aqueous solution containing a dispersant to effect emulsification, then heat is applied to evaporate the organic solvent, thereby solidifying the emulsion as fine particles. This method is referred to herein as the "dissolution-dispersion method."

Exemplary thermally reactive polymer fine particles include thermoset polymer fine particles and polymer fine particles having thermally reactive groups.

Illustrative examples of thermoset polymer fine particles include resins having a phenol skeleton, urea resins (e.g., urea or a urea derivative such as methoxymethylated urea which has been resinified with an aldehyde such as formaldehyde), melamine resins (e.g., melamine or a derivative thereof which has been resinified with an aldehyde such as formaldehyde), alkyd resins, unsaturated polyester resins, polyurethane resins and epoxy resins. Of these, resins having a phenol skeleton, melamine resins, urea resins and epoxy resins are preferred.

Preferred examples of resins having a phenol skeleton include phenolic resins and hydroxystyrene resins obtained by resinifying phenol, cresol or the like with an aldehyde such as formaldehyde; methacrylamides or acrylamides having a phenol skeleton, such as N-(p-hydroxyphenyl)methacrylamide or p-hydroxyphenyl methacrylate; and polymers or copolymers of such methacrylates or acrylates.

The thermoset polymer fine particles have an average particle size of preferably 0.01 to 2.0 μm.

No particular limitation is imposed on the method of preparing thermoset polymer fine particles. Such particles can easily be obtained by the above-described dissolution-dispersion method, while they may also be obtained by fine particle formation during synthesis of the thermoset polymer.

The thermally reactive groups on the polymer fine particles having thermally reactive groups may be any type of functional group that carries out a reaction so long as a chemical bond forms. Preferred examples include radical polymerizable groups (e.g., ethylenically unsaturated bond-containing groups such as acryloyl, methacryloyl, vinyl and allyl); cationic polymerizable groups (e.g., vinyl and vinyloxy); isocyanate or blocked isocyanate groups, epoxy groups and vinyloxy groups which carry out addition reactions, along with active hydrogen-bearing functional groups that react therewith (e.g., amino groups, hydroxyl groups, carboxyl groups); carboxyl groups which carry out condensation reactions, along with hydroxyl groups or amino groups that react therewith; and acid anhydride groups which carry out ring-opening addition reactions, along with amino or hydroxyl groups that react therewith.

These functional groups may be introduced into the polymer fine particles during polymerization or may be introduced after polymerization by utilizing a polymer reaction.

In cases where the functional groups are introduced during polymerization, it is preferable to emulsion polymerize or suspension polymerize a monomer having the above thermally reactive group. Specific examples of monomers having thermally reactive groups include allyl methacrylate, allyl acrylate, vinyl methacrylate, vinyl acrylate, 2-(vinyloxy)ethyl methacrylate, p-vinyloxystyrene, p-[2-(vinyloxy)ethyl]styrene, glycidyl methacrylate, glycidyl acrylate, 2-isocyanatoethyl methacrylate and blocked isocyanates thereof blocked by alcohol or the like, 2-isocyanatoethyl acrylate and blocked isocyanates thereof blocked by alcohol or the like, 2-aminoethyl methacrylate, 2-aminoethyl acrylate, 2-hydroxyethyl methacrylate, 2-hydroxyethyl acrylate, acrylic acid, methacrylic acid, maleic anhydride, bifunctional acrylate and bifunctional methacrylate.

Copolymers of these thermally reactive group-bearing monomers with thermally reactive group-free monomers that are copolymerizable therewith may also be used. Illustrative, non-limiting examples of the thermally reactive group-free monomers include styrene, alkyl acrylate, alkyl methacrylate, acrylonitrile and vinyl acetate.

Examples of the polymer reaction used when introduction of the thermally reactive group is carried out after polymerization include the polymer reactions mentioned in WO 96/34316.

Of the polymer fine particles having thermally reactive groups, those in which the particles mutually coalesce under heating are preferred, and those which have a hydrophilic surface and disperse in water are especially preferred. It is desirable in this case for a film formed by applying only the polymer fine particles and drying at a lower temperature than the solidification temperature to have a contact angle (water drop in air) which is smaller than the contact angle (water drop in air) of a film that is similarly formed but dried at a temperature higher than the solidification temperature.

An illustrative, non-limiting example of a method for making the surface of the polymer fine particles hydrophilic in this way involves the adsorption of a hydrophilic polymer or oligomer such as polyvinyl alcohol or polyethylene glycol, or of a hydrophilic low-molecular-weight compound onto the surface of the polymer fine particles.

It is preferable for the thermally reactive group-bearing polymer fine particles to have a solidification temperature of at least 70° C., and a solidification temperature of at least 100° C. is especially preferred for good stability over time. The polymer fine particles have an average particle size of preferably 0.01 to 2.0 μm, more preferably 0.05 to 2.0 μm, and most preferably 0.1 to 1.0 μm. Within the above range, good resolution and stability over time can be achieved.

The hydrophobic compound contained within microcapsules is preferably a compound having thermally reactive groups. Preferred examples of the thermally reactive groups are the same as those that may be used in thermally reactive group-bearing polymer fine particles. The thermally reactive group-bearing compounds are described in greater detail later in this specification.

Preferred examples of compounds having radical polymerizable groups include compounds with at least one, and preferably at least two, ethylenically unsaturated bonds (e.g., acryloyl, methacryloyl, vinyl, allyl). Such compounds are widely used as monomers or crosslinking agents for polymerizable compositions in industrial fields related to the present invention, and may be used herein without any particular limitation. These compounds have a variety of chemical forms, including monomers, prepolymers (e.g., dimers, trimers, and oligomers), polymers or copolymers, and mixtures thereof.

Specific examples include the compounds mentioned in JP 2001-277740 A as compounds having polymerizable unsaturated groups. Typical examples of such compounds include trimethylolpropane di(meth)acrylate, trimethylolpropane tri(meth)acrylate, pentaerythritol di(meth)acrylate, pentaerythritol tri(meth)acrylate, pentaerythritol tetra(meth)acrylate, dipentaerythritol di(meth)acrylate, dipentaerythritol penta(meth)acrylate, dipentaerythritol hexa(meth)acrylate, and adducts of trimethylolpropane diacrylate and xylylene diisocyanate.

Exemplary polymers or copolymers having ethylenically unsaturated bond-containing groups include allyl methacrylate copolymers. Specific examples include allyl methacrylate/methacrylic acid copolymers, allyl methacrylate/ethyl methacrylate copolymers and allyl methacrylate/butyl methacrylate copolymers.

Exemplary vinyloxy group-bearing compounds include those mentioned in JP 2002-29162 A. Specific examples include tetramethylene glycol divinyl ether, trimethylolpropane trivinyl ether, tetraethylene glycol divinyl ether, pentaerythritol divinyl ether, pentaerythritol trivinyl ether, pentaerythritol tetravinyl ether, 1,4-bis[2-(vinyloxy)ethyloxy]benzene, 1,2-bis[2-(vinyloxy)ethyloxy]benzene, 1,3-bis[2-(vinyloxy)ethyloxy]benzene, 1,3,5-tris[2-(vinyloxy)ethyloxy]benzene, 4,4'-bis[2-(vinyloxy)ethyloxy]biphenyl, 4,4'-bis[2-(vinyloxy)ethyloxy]diphenyl ether, 4,4'-bis[2-(vinyloxy)ethyloxy]diphenylmethane, 1,4-bis[2-(vinyloxy)ethyloxy]naphthalene, 2,5-bis[2-(vinyloxy)ethyloxy]furan, 2,5-bis[2-(vinyloxy)ethyloxy]thiophene, 2,5-bis[2-(vinyloxy)ethyloxy]imidazole, 2,2-bis[4-[2-(vinyloxy)ethyloxy]phenyl]propane (the bis(vinyloxyethyl)ether of bisphenol A), 2,2-bis[4-(vinyloxymethyloxy)phenyl]propane and 2,2-bis[4-(vinyloxy)phenyl]propane.

Preferred epoxy group-bearing compounds are compounds having at least two epoxy groups. Preferred examples include glycidyl ether compounds obtained by the reaction of a polyol or polyphenol with epichlorohydrin, or prepolymers thereof, and polymers or copolymers of glycidyl acrylate or glycidyl methacrylate.

Specific examples include propylene glycol diglycidyl ether, tripropylene glycol diglycidyl ether, polypropylene glycol diglycidyl ether, neopentyl glycol diglycidyl ether, trimethylolpropane triglycidyl ether, the diglycidyl ether of hydrogenated bisphenol A, hydroquinone diglycidyl ether, resorcinol diglycidyl ether, the diglycidyl ether or epichlorohydrin polyadduct of bisphenol A, the diglycidyl ether or epichlorohydrin polyadduct of bisphenol F, the diglycidyl ether or epichlorohydrin polyadduct of halogenated bisphenol A, the diglycidyl ether or epichlorohydrin polyadduct of biphenyl-type bisphenol, glycidyl etherification products of novolak resins, methyl methacrylate/glycidyl methacrylate copolymers and ethyl methacrylate/glycidyl methacrylate copolymers.

Illustrative examples of the above compounds in the form of commercial products include Epikote 1001 (molecular weight, about 900; epoxy equivalent weight, 450 to 500), Epikote 1002 (molecular weight, about 1,600; epoxy equivalent weight, 600 to 700), Epikote 1004 (molecular weight, about 1,060; epoxy equivalent weight, 875 to 975), Epikote 1007 (molecular weight, about 2,900; epoxy equivalent weight, 2,000), Epikote 1009 (molecular weight, about 3,750; epoxy equivalent weight, 3,000), Epikote 1010 (molecular weight, about 5,500; epoxy equivalent weight, 4,000), Epikote 1100L (epoxy equivalent weight, 4,000) and Epikote YX31575 (epoxy equivalent weight, 1,200), all of which are produced by Japan Epoxy Resins Co., Ltd.; and Sumiepoxy ESCN-195XHN, ESCN-195XL and ESCN-195XF, all of which are produced by Sumitomo Chemical Co., Ltd.

Illustrative examples of isocyanate group-bearing compounds include tolylene diisocyanate, diphenylmethane diisocyanate, polymethylene polyphenyl polyisocyanate, xylylene diisocyanate, naphthalene diisocyanate, cyclohexanephenylene diisocyanate, isophorone diisocyanate, hexamethylene diisocyanate, cyclohexyl diisocyanate, and compounds obtained by blocking any of the above with alcohol or amine.

Exemplary amino group-bearing compounds include ethylenediamine, diethylenetriamine, triethylenetetraamine, hexamethylenediamine, propylenediamine and polyethyleneimine.

Exemplary hydroxyl group-bearing compounds include compounds having terminal methylol groups, polyols such as pentaerythritol, bisphenols and polyphenols.

Exemplary carboxyl group-bearing compounds include aromatic polycarboxylic acids such as pyromellitic acid, trimellitic acid and phthalic acid; and aliphatic polycarboxylic acids such as adipic acid.

Exemplary acid anhydride group-bearing compounds include pyromellitic anhydride and benzophenonetetracarboxylic anhydride.

A known method may be used for microencapsulating the thermally reactive group-bearing compound. Illustrative, non-limiting examples of techniques for preparing microcapsules include the methods involving the use of coacervation described in U.S. Pat. Nos. 2,800,457 and 2,800,458; the methods that rely on interfacial polymerization described in GB 990,443 B, U.S. Pat. No. 3,287,154, JP 38-19574 B (the term "JP XX-XXXXXX B" as used herein means an "examined Japanese patent publication"), JP 42-446 B and JP 42-711 B; the methods involving polymer precipitation described in U.S. Pat. Nos. 3,418,250 and 3,660,304; the method that uses an isocyanate polyol wall material described in U.S. Pat. No. 3,796,669; the method that uses an isocyanate wall material described in U.S. Pat. No. 3,914,511; the methods that use a urea-formaldehyde or urea-formaldehyde-resorcinol wall-forming material described in U.S. Pat. Nos. 4,001,140, 4,087,376 and 4,089,802; the method which uses wall materials such as melamine-formaldehyde resins and hydroxycellulose described in U.S. Pat. No. 4,025,445; the in situ methods involving monomer polymerization that are taught in JP 36-9163 B and JP 51-9079 B; the spray drying processes described in GB 930,422 B and U.S. Pat. No. 3,111,407; and the electrolytic dispersion cooling processes described in GB 952,807 B and GB 967,074 B.

It is advantageous for the microcapsule walls to have three-dimensional crosslinkages and to be solvent-swellable. Accordingly, it is preferable for the microcapsule wall material to be polyurea, polyurethane, polyester, polycarbonate, polyamide or a mixture thereof. Polyurea and polyurethane are especially preferred. The microcapsule wall may have introduced therein the thermally reactive group-bearing compound.

The microcapsules preferably have an average particle size of 0.01 to 3.0 μm, more preferably 0.05 to 2.0 μm, and most preferably 0.10 to 1.0 μm. Within the above range, it is possible to obtain a good resolution and a good stability over time.

Such microcapsules may or may not mutually coalesce under heating. For example, a substance contained within the microcapsules which is present on the surface of or exudes from the microcapsules during application of the image recording layer, or a substance which enters the microcapsules through the walls may be induced to chemically react under heating. Reaction may take place with a hydrophilic resin that has been added or with a low-molecular-weight compound that has been added. Alternatively, two or more types of microcapsules may each be provided with different functional groups which thermally react with each other, and the different types of microcapsules induced to mutually react. Therefore, it is desirable, though not essential, for good image formation that the microcapsules melt and coalesce with each other under heating.

The amount of thermoplastic polymer fine particles, thermally reactive polymer fine particles, and hydrophobic compound-containing microcapsules in the image recording layer is preferably not more than 50 wt %, and most preferably 70 to 98 wt %, based on the total solids in the image recording layer. Within this range, a good image can be formed and a long press life can be achieved.

In cases where microcapsules are included in the image recording layer, a solvent which dissolves the microcapsule contents and causes the wall material to swell may be added to the microcapsule dispersing medium. The presence-of this type of solvent promotes the diffusion of the encapsulated thermally reactive group-bearing compound out of the microcapules. The particular solvent used will depend on the microcapsule dispersing medium, the material making up the microcapsule wall, the wall thickness and the microcapsule contents, but may easily be selected from many commercially available solvents. For example, in the case of water-dispersible microcapsules composed of a crosslinked polyurea or polyurethane wall, preferred solvents include alcohols, ethers, acetals, esters, ketones, polyols, amides, amines and fatty acids.

Specific examples include methanol, ethanol, t-butanol, n-propanol, tetrahydrofuran, methyl lactate, ethyl lactate, methyl ethyl ketone, propylene glycol monomethyl ether, ethylene glycol diethyl ether, ethylene glycol monomethyl ether, γ-butyrolactone, N,N-dimethylformamide and N,N-dimethylacetamide. It is also possible to use two or more of these solvents together.

Use can also be made of a solvent which will not dissolve in the microcapsule dispersion itself, but will dissolve in a microcapsule dispersion in which the solvent has been mixed.

Such a solvent is added in an amount which is selected according to the combination of ingredients, preferably 5 to 95 wt %, more preferably 10 to 90 wt %, and most preferably 15 to 85 wt %, based on the overall amount of the coating fluid.

To enhance the on-machine developability and film strength, the image recording layer may include a hydrophilic resin. Preferred examples include hydrophilic resins having hydrophilic groups such as hydroxyl, amino, carboxyl, phosphoric acid groups, sulfo groups and amide groups.

Moreover, the presence in the hydrophilic resin of groups which react with the thermally reactive groups is desirable because such groups react with the thermally reactive groups on the hydrophobic compound included in the microcapsules and form crosslinkages, increasing the image strength and improving the press life of the printing plate. To illustrate, when the hydrophobic compound has a vinyloxy or an epoxy group, it is preferable for the hydrophilic resin to have, for example, hydroxyl groups, carboxyl groups, phosphoric acid groups or sulfo groups. A hydrophilic resin having hydroxyl groups or carboxyl groups is especially preferred.

Specific examples of the hydrophilic resin include gum arabic, casein, gelatin, starch derivatives, soya gum, hydroxypropyl cellulose, methyl cellulose, carboxymethyl cellulose and its sodium salt, cellulose acetate, sodium alginate, vinyl acetate-maleic acid copolymers, styrene-maleic acid copolymers, polyacrylic acids and their salts, polymethacrylic acids and their salts, homopolymers and copolymers of hydroxyethyl methacrylate, homopolymers and copolymers of hydroxyethyl acrylate, homopolymers and copolymers of hydroxypropyl methacrylate, homopolymers and copolymers of hydroxypropyl acrylate, homopolymers and copolymers of hydroxybutyl methacrylate, homopolymers and copolymers of hydroxybutyl acrylate, polyethylene glycols, hydroxypropylene polymers, polyvinyl alcohols, hydrolyzed polyvinyl acetates having a degree of hydrolysis of at least 60 wt %, and preferably at least 80 wt %, polyvinyl formal, polyvinyl pyrrolidone, the homopolymers and copolymers of acrylamides, the homopolymers and copolymers of methacrylamides, the homopolymers and copolymers of N-methylolacrylamide, the homopolymers and copolymers of 2-acrylamido-2-methyl-1-propanesulfonic acid and the homopolymers and copolymers of 2-(methacryloyloxy)ethyl phosphoric acid.

The amount of hydrophilic resin in the image recording layer is preferably not more than 20 wt %, and more preferably not more than 10 wt %.

A hydrophilic resin may be crosslinked and used insofar as unexposed areas of the plate are developable on the printing press. Illustrative examples of crosslinking agents include aldehydes such as glyoxal, melamine-formaldehyde resins and urea-formaldehyde resins; methylol compounds such as N-methylolurea, N-methylolmelamine and methylolated polyamide resins; active vinyl compounds such as divinylsulfone and bis(β-hydroxyethylsulfonic acid); epoxy compounds such as epichlorohydrin, polyethylene glycol diglycidyl ether, polyamide, polyamine, epichlorohydrin adducts and polyamide epichlorohydrin resin; ester compounds such as monochloroacetic acid esters and thioglycolic acid esters; polycarboxylic acids such as polyacrylic acid and methyl vinyl ether/maleic acid copolymers; inorganic crosslinking agents such as boric acid, titanyl sulfate, and copper, aluminum, tin, vanadium and chromium salts; and modified polyamide-polyimide resins.

Concomitant use can also be made of co-crosslinking agents such as ammonium chloride, silane coupling agents and titanate coupling agents.

To increase sensitivity, it is desirable for the image recording layer to include a photothermal conversion substance having the ability to convert light energy to heat energy. The photothermal conversion substance may be any substance which absorbs infrared light, and preferably near-infrared light (wavelength, 700 to 2000 nm). Various known pigments, dyes and finely divided metals may be used in this way.

Preferred examples include the pigments, dyes and finely divided metals mentioned in JP 2001-301350 A, JP 2002-137562 A, and "New Imaging Materials: 2. Near-Infrared Absorbing Dyes" in *Nippon Insatsu Gakkaishi* 38 (2001), pp. 35–40.

If necessary, the pigments and finely divided metals may be used after being administered a known surface treatment.

Suitable pigments include insoluble azo pigments, azo lake pigments, condensed azo pigments, chelate azo pigments, phthalocyanine pigments, anthraquinone pigments, perylene and perinone pigments, thioindigo pigments, quinacridone pigments, dioxazine pigments, isoindolinone pigments, quinophthalone pigments, lake pigments, azine pigments, nitroso pigments, nitro pigments, natural pigments, fluorescent pigments, inorganic pigments and carbon black. Of these, carbon black is preferred.

Suitable dyes include the cyanine dyes, polymethine dyes, azomethine dyes, squarylium dyes, pyrylium and thiopyrylium salt dyes, dithiol metal complexes and phthalocyanine dyes mentioned in U.S. Pat. Nos. 4,756,993, 4,973,572, JP 10-268512 A, JP 11-235883 A, JP 5-13514 B, JP 5-19702 B and JP 2001-347765 A. Of these, cyanine dyes, squarylium dyes, pyrylium salt dyes and phthalocyanine dyes are preferred.

Preferred examples of finely divided metals include finely divided silver, gold, copper, antimony, germanium and lead. Finely divided silver, gold and copper are especially preferred.

Addition of the photothermal conversion substance to the image recording layer may be achieved by including the substance within the thermoplastic polymer fine particles, thermally reactive polymer fine particles and microcapsules containing hydrophobic compound, or by adding the substance to a hydrophilic medium thereof.

Especially preferred examples of the photothermal conversion substance are shown below. Substances IR-1 to IR-11 below are hydrophilic photothermal conversion substances suitable for addition to a hydrophilic medium. Substances IR-21 to IR-29 are oleophilic photothermal conversion substances suitable for addition by being included within thermoplastic polymer fine particles, thermally reactive polymer fine particles and microcapsules containing hydrophobic compounds.

<IR-1 to IR-29 Formulas>
(IR-1)
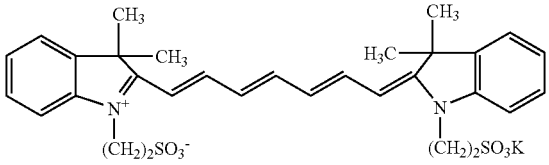
(IR-2)
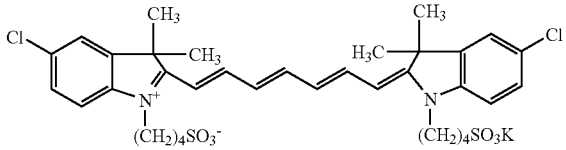
(IR-3)
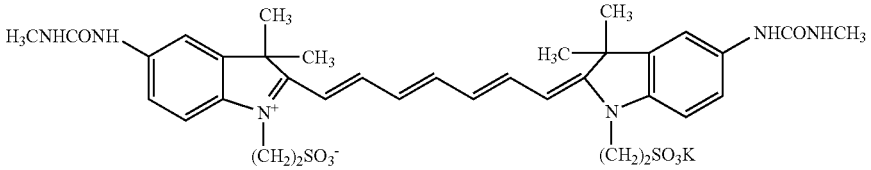
(IR-4)
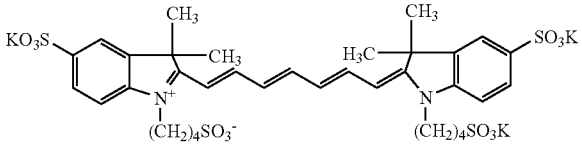
(IR-5)
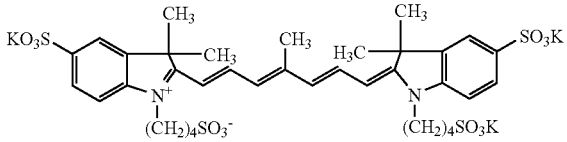
(IR-6)
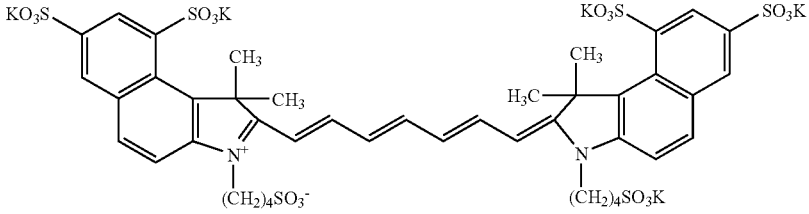
(IR-7)
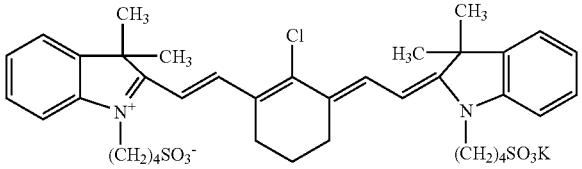
(IR-8)
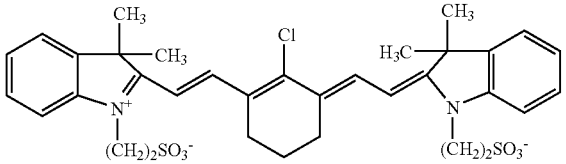
$HN^+(C_2H_5)_3$
(IR-9)
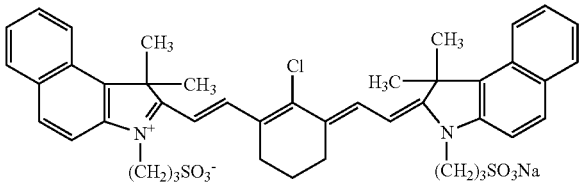
(IR-10)
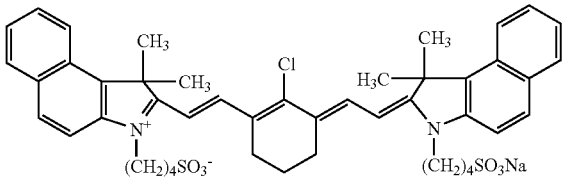
(IR-11)
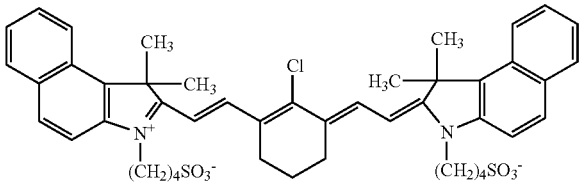
$HN^+(C_2H_5)_3$
(IR-21)
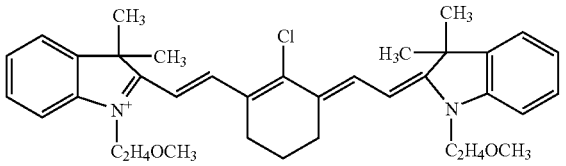
$BF_4^-$ -continued
(IR-22)
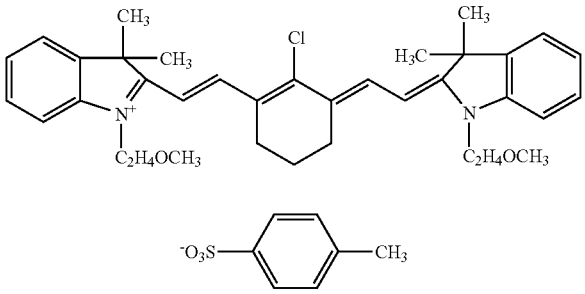
(IR-23)
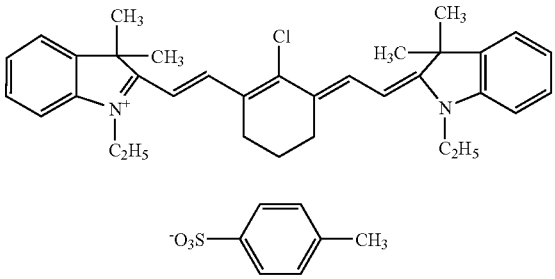
(IR24)
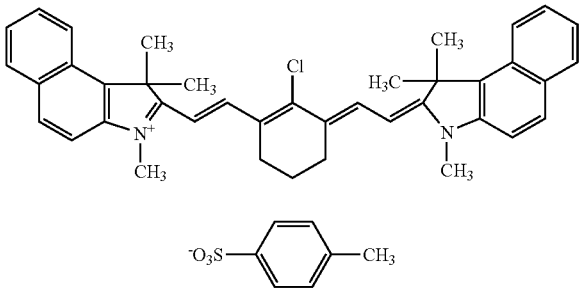
(IR-25)
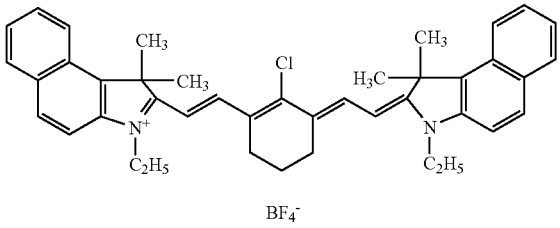
$BF_4^-$
(IR-26)
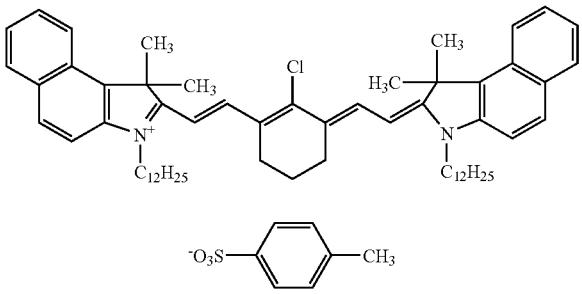
(IR-27)
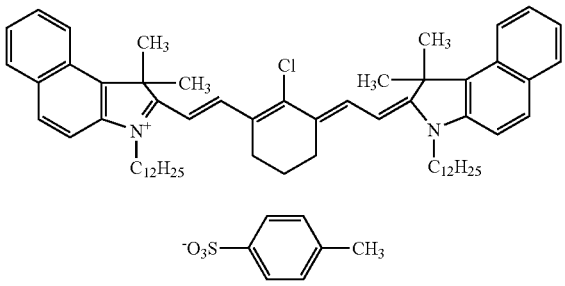
(IR-28)
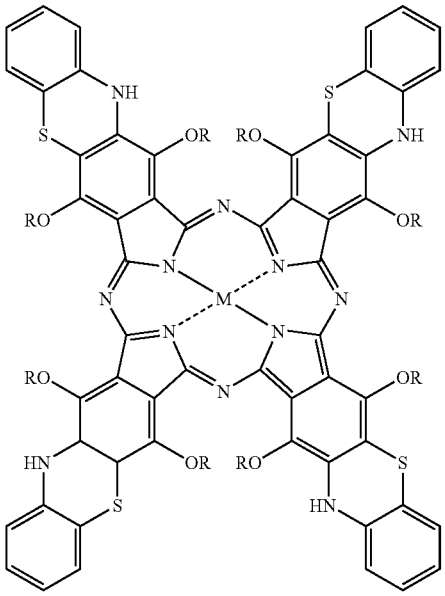
M = VO, R = i-$C_5H_{11}$
(IR-29)
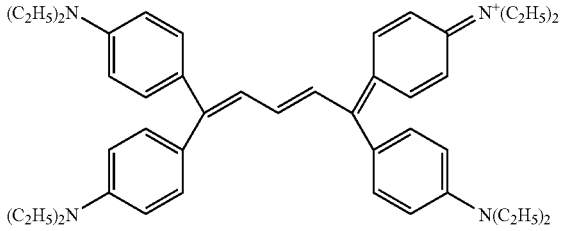
$BF_4^-$ The content of the photothermal conversion substance is preferably 1 to 50 wt %, and more preferably 3 to 25 wt %, based on the total solids of the image recording layer. Within this range, a good sensitivity can be obtained without compromising the film strength of the image recording layer.

The image recording layer can include a reaction promoter which initiates or promotes reaction of the thermally reactive groups. Because the reaction promoter generates an acid or a radical, when used in combination with a dye that changes color under the influence of the generated acid or radical, it can form a print-out system. Suitable reaction promoters of this type include known acid precursors, acid generators and thermal radical generators, such as photoinitiators for photocationic polymerization, photoinitiators for photoradical polymerization, acid generators for forming print-out images, and acid generators used in microresists and the like.

Specific examples include the followings mentioned in JP 2002-29162 A, JP 2002-46361 A and JP 2002-137562 A: organohalogen compounds such as trihalomethyl-substituted heterocyclic compounds, iminosulfonates and other compounds which undergo photodecomposition and generate sulfonic acid, disulfone compounds, and onium salts (e.g., iodonium salts, diazonium salts, sulfonium salts). Use can also be made of compounds obtained by introducing such acid- or radical-generating groups or compounds onto the main chains or side chains of a polymer. Examples are given below.

<Formulas>

(A-1)

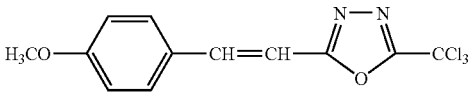

(A-2)

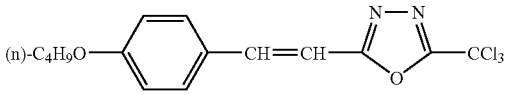

(A-3)

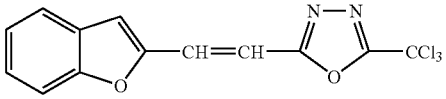

(A-4)

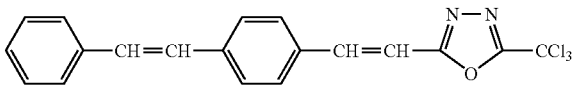

(A-5)

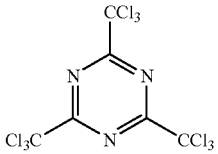

(A-6)

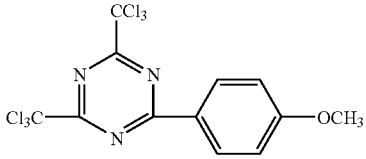

-continued (A-7)

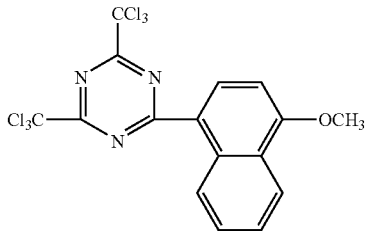

(A-8)

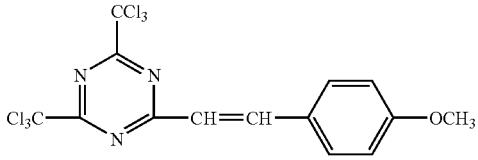

(A-9)

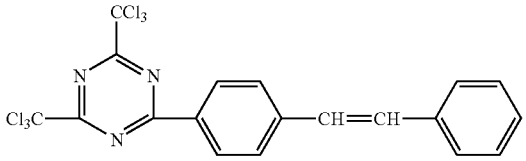

(A-10)

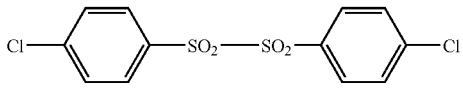

(A-11)

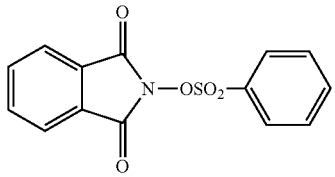

(AI-1)

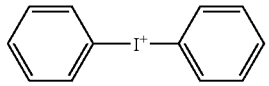

$BPh_4^-$ (AI-2)

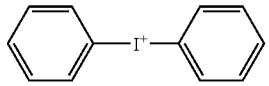

$PF_6^-$ (AI-3)

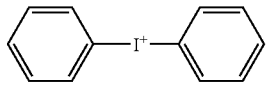

$ClO_4^-$ (AI-4)

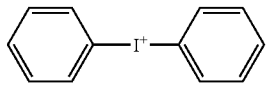

$HSO_4^-$ (AI-5)

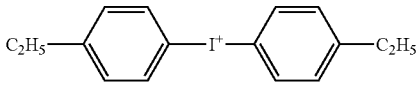

$HSO_4^-$

-continued
(AI-6)
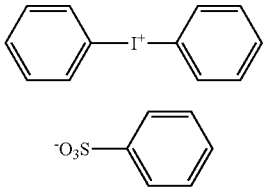
(AI-7)
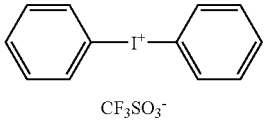
$CF_3SO_3^-$
(AI-8)
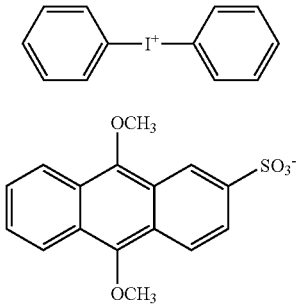
(AI-9)
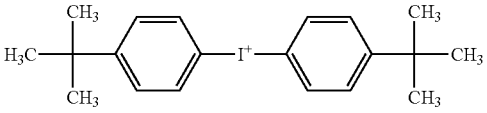
$PF_6^-$
(AI-10)
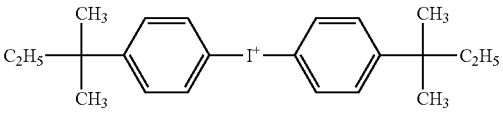
$PF_6^-$
(AI-11)
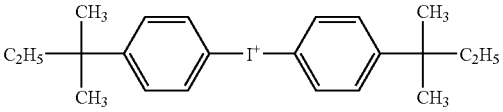
$ClO_4^-$
(AI-12)
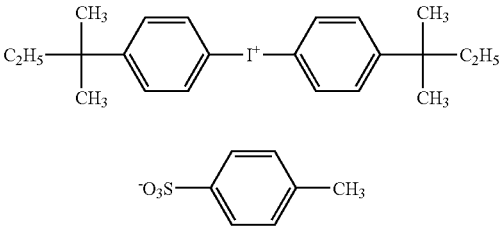
-continued
(AI-13)
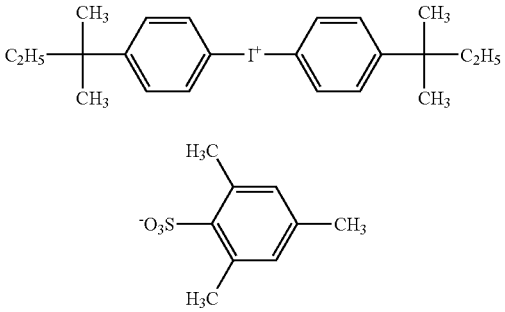
(AI-14)
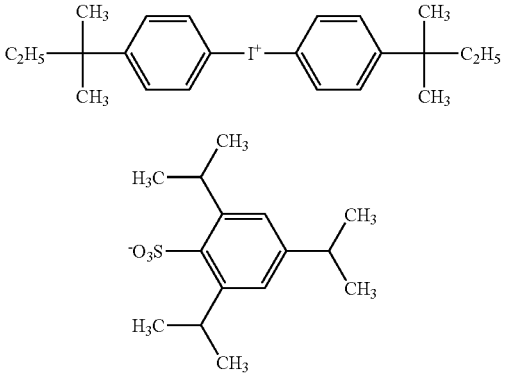
(AI-15)
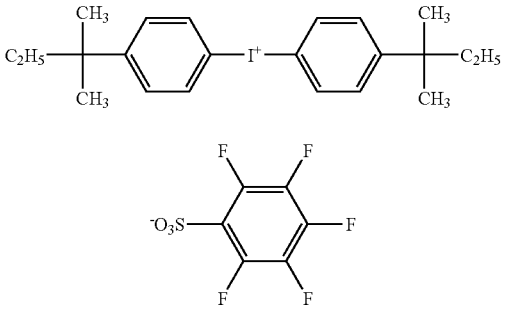
(AI-16)
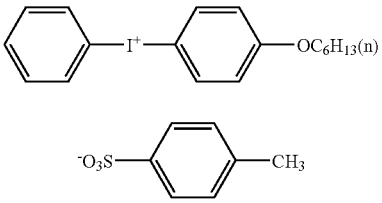
(AI-17)
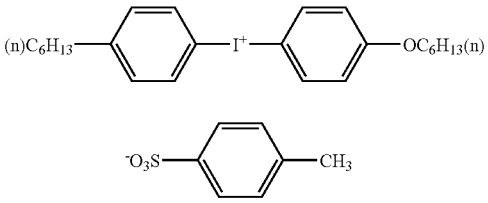

-continued
(AN-1)
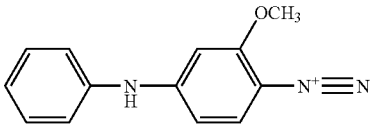
$PF_6^-$
(AN-2)
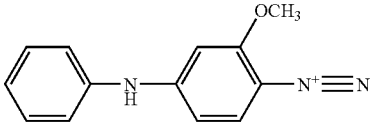
$HSO_4^-$
(AN-3)
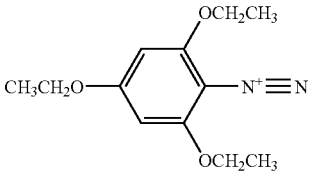
$PF_6^-$
(AN-4)
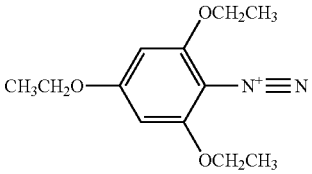
$HSO_4^-$
(AN-5)
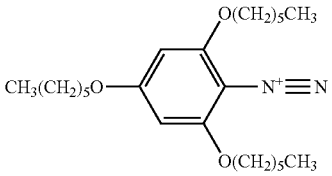
$PF_6^-$
(AN-6)
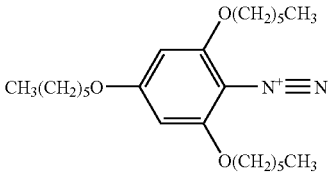
$HSO_4^-$
-continued
(AN-7)
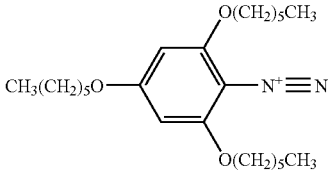
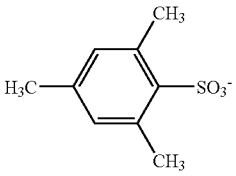
(AN-8)
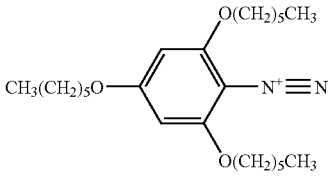
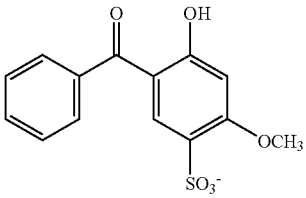
(AS-1)
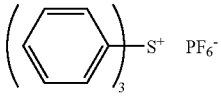
$PF_6^-$
(AS-2)
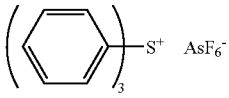
$AsF_6^-$
(AS-3)
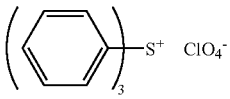
$ClO_4^-$
(AS-4)
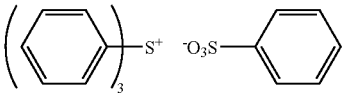
(AS-5)
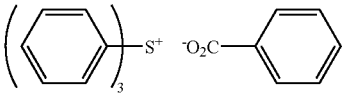
(AS-6)
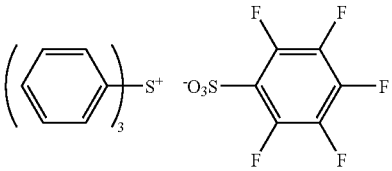
(AS-7)
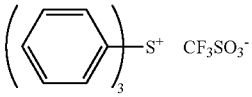
$CF_3SO_3^-$ -continued (AS-8)

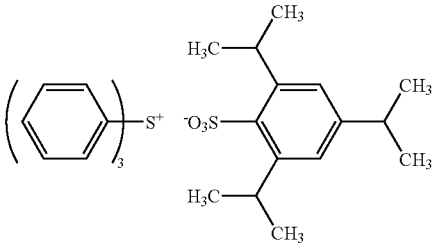

(AS-9)

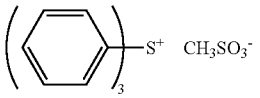

(AS-10)

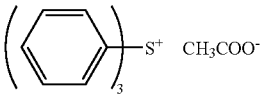

(AS-11)

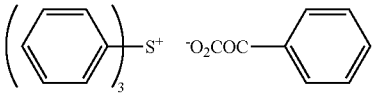

(AS-12)

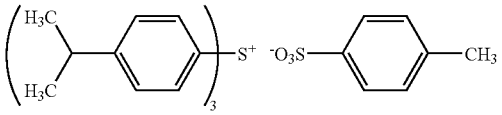

Two or more reaction promoters may be used in combination. The reaction promoter may be added directly to the image recording layer-forming coating fluid, or may be added by inclusion in polymer fine particles or microcapsules. The content of reaction promoter in the image recording layer is preferably 0.01 to 20 wt %, and more preferably 0.1 to 10 wt %, based on the total solids in the image recording layer. Within this range, good reaction initiating effects or reaction promoting effects can be obtained without compromising the on-machine developability.

An acid- or radical-responsive chromogenic compound may be added to the image recording layer in order to form a print-out image. Examples of such compounds which can be effectively used for this purpose include diphenylmethane, triphenylmethane, thiazine, oxazine, xanthene, anthraquinone, iminoquinone, azo and azomethine dyes.

Specific examples include dyes such as Brilliant Green, Ethyl Violet, Methyl Green, Crystal Violet, Basic Fuchsin, Methyl Violet 2B, Quinaldine Red, Rose Bengal, Metanil Yellow, thymolsulfophthalein, Xylenol Blue, Methyl Orange, Paramethyl Red, Congo Red, Benzopurpurin 4B, α-Naphthyl Red, Nile Blue 2B, Nile Blue A, Methyl Violet, Malachite Green, Parafuchsin, Victoria Pure Blue BOH (produced by Hodogaya Chemical Co., Ltd.), Oil Blue #603 (Orient Chemical Industries, Ltd.), Oil Pink #312 (Orient Chemical Industries), Oil Red 5B (Orient Chemical Industries), Oil Scarlet #308 (Orient Chemical Industries), Oil Red OG (Orient Chemical Industries), Oil Red RR (Orient Chemical Industries), Oil Green #502 (Orient Chemical Industries), Spiron Red BEH Special (Hodogaya Chemical), m-Cresol Purple, Cresol Red, Rhodamine B, Rhodamine 6G, Sulforhodamine B, Auramine, 4-p-diethylaminophenyliminonaphthoquinone, 2-carboxyanilino-4-p-diethylaminophenyliminonaphthoquinone, 2-carboxystearylamino-4-p-N,N-bis(hydroxyethyl) aminophenyliminonaphthoquinone, 1-phenyl-3-methyl-4-p-diethylaminophenylimino-5-pyrazolone and 1-β-naphthyl-4-p-diethylaminophenylimino-5-pyrazolone; and leuco dyes such as p,p',p"-hexamethyltriaminotriphenylmethane (Leuco Crystal Violet) and Pergascript Blue SRB (produced by Ciba Geigy).

Advantageous use can also be made of leuco dyes known to be used in heat-sensitive or pressure-sensitive paper. Specific examples include Crystal Violet Lactone, Malachite Green Lactone, Benzoyl Leucomethylene Blue, 2-(N-phenyl-N-methylamino)-6-(N-p-tolyl-N-ethyl)aminofluoran, 2-anilino-3-methyl-6-(N-ethyl-p-toluidino)fluoran, 3,6-dimethoxyfluoran, 3-(N,N-diethylamino)-5-methyl-7-(N,N-dibenzylamino)-fluoran, 3-(N-cyclohexyl-N-methylamino)-6-methyl-7-anilinofluoran, 3-(N,N-diethylamino)-6-methyl-7-anilinofluoran, 3-(N,N-diethylamino)-6-methyl-7-xylidinofluoran, 3-(N,N-diethylamino)-6-methyl-7-chlorofluoran, 3-(N,N-diethylamino)-6-methoxy-7-aminofluoran, 3-(N,N-diethylamino)-7-(4-chloroanilino) fluoran, 3-(N,N-diethylamino)-7-chlorofluoran, 3-(N,N-diethylamino)-7-benzylaminofluoran, 3-(N,N-diethylamino)-7,8-benzofluoran, 3-(N,N-dibutylamino)-6-methyl-7-anilinofluoran, 3-(N,N-dibutylamino)-6-methyl-7-xylidinofluoran, 3-piperidino-6-methyl-7-anilinofluoran, 3-pyridino-6-methyl-7-anilinofluoran, 3,3-bis(1-ethyl-2-methylindol-3-yl)phthalide, 3,3-bis(1-n-butyl-2-methylindol-3-yl)phthalide, 3,3-bis(p-dimethylaminophenyl)-6-dimethylaminophthalide, 3-(4-diethylamino-2-ethoxyphenyl)-3-(1-ethyl-2-methylindol-3-yl)-4-azaphthalide and 3-(4-diethylaminophenyl)-3-(1-ethyl-2-methylindol-3-yl) phthalide.

Regardless of the acid- or radical-responsive chromogenic dye used, the content thereof is preferably from 0.01 to 10 wt %, based on the total solids in the image recording layer.

If necessary, various compounds other than those mentioned above may also be added to the image recording layer. For example, to further improve the press life, a polyfunctional monomer may be added to the image recording layer matrix. Illustrative examples of such polyfunctional monomers include those mentioned above as monomers included in the microcapsules. Of these, preferred examples include trimethylolpropane triacrylate and pentaerythritol triacrylate.

To prevent unwanted thermal polymerization of the thermally reactive groups during preparation or storage of the image recording layer-forming coating fluid, it is desirable to add a small amount of thermal polymerization inhibitor. Preferred examples of the thermal polymerization inhibitor include hydroquinone, p-methoxyphenol, di-t-butyl-p-cresol, pyrogallol, t-butylcatechol, benzoquinone, 4,4'-thiobis(3-methyl-6-t-butylphenol), 2,2'-methylenebis(4-methyl-6-t-butylphenol) and the aluminum salt of N-nitroso-N-phenylhydroxylamine. The thermal polymerization inhibitor is added in an amount of preferably 0.01 to 5 wt %, based on the image recording layer-forming coating fluid.

If necessary, to prevent the inhibition of polymerization by oxygen, a higher fatty acid (e.g., behenic acid) or a derivative thereof (e.g., behenamide) may be added and induced to concentrate primarily at the surface of the image recording layer as the layer dries after coating. The higher fatty acid or derivative thereof is added in an amount of preferably 0.1 to 10 wt %, based on the total solids in the image recording layer.

The image recording layer may contain fine inorganic particles. Preferred examples include finely divided silica, alumina, magnesium oxide, titanium oxide, magnesium carbonate, calcium alginate, and mixtures thereof. Even if these are incapable of photothermal conversion, they can be used for such purposes as reinforcing the film and increasing interfacial adhesion from surface graining.

The inorganic particles have an average size of preferably 5 nm to 10 μm, and more preferably 10 nm to 1 μm. Within this range, they disperse stably in the hydrophilic resin together with finely divided resin or together with the finely divided metal included as the photothermal conversion substance, thus enabling the image recording layer to maintain a sufficient film strength and enabling the formation of non-image areas having excellent hydrophilic properties that are not easily contaminated during printing.

Such inorganic particles are readily available as colloidal silica dispersions and other commercial products. The content of these fine inorganic particles is preferably not more than 20 wt %, and more preferably not more than 10 wt %, based on the total solids in the image recording layer.

To enhance the dispersion stability, platemaking properties, printing performance, coatability and other properties of the image recording layer, the layer may also include a nonionic, anionic, cationic, amphoteric or fluorocarbon surfactant mentioned in JP 2-195356 A, JP 59-121044 A, JP 4-13149 A and JP 2002-365789 A. The amount of surfactant added is preferably from 0.005 to 1 wt %, based on the total solids in the image recording layer.

If necessary, a plasticizer may be added to the image recording layer to impart flexibility and other desirable properties to the applied film. Preferred examples of the plasticizer include polyethylene glycol, tributyl citrate, diethyl phthalate, dibutyl phthalate, dihexyl phthalate, dioctyl phthalate, tricresyl phosphate, tributyl phosphate, trioctyl phosphate and tetrahydrofurfuryl oleate.

The image recording layer is formed by dispersing or dissolving each of the above components in a solvent to prepare a coating fluid, then coating the fluid on the support and drying the applied fluid. Illustrative, non-limiting examples of the solvent include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethylsulfoxide, sulfolane, γ-butyrolactone, toluene and water. These solvents may be used singly or as mixtures thereof. The coating fluid has a solids concentration of preferably from 1 to 50 wt %.

The coating amount (solids content) used to form the image recording layer varies depending on the intended application, while an amount of 0.5 to 5.0 g/m$^2$ is generally preferred. Too small amount of a coating will result in a large apparent sensitivity, but diminish the film properties of the image recording layer.

Any of various coating methods may be used. Examples of suitable methods of coating include bar coating, spin coating, spray coating, curtain coating, dip coating, air knife coating, blade coating and roll coating.

Overcoat Layer:

To protect the surface of the image recording layer from scum by oleophilic substances during storage and from scum such as fingerprints due to finger contact during handling, the plate may be provided on the image recording layer with an overcoat layer containing a water-soluble resin such as gum arabic, polyacrylic acid or cellulose derivative mentioned in JP 2001-162961 A.

The plate may be provided with a hydrophobic overcoat layer which has a larger contact angle (water drop contact angle in air) than the contact angle of the image recording layer.

Examples of organic polymeric compounds which may be used in the hydrophobic overcoat layer include polybutene, polybutadiene, saturated polyester resins, unsaturated polyester resins, nylon, polyurethane, polyurea, polyimide, polysiloxane, polycarbonate, epoxy resins, phenoxy resins, chlorinated polyethylene, aldehyde condensation resins of alkylphenols, acetal resins, polyvinyl chloride, polyvinylidene chloride, polystyrene, acrylic resins and copolymer resins thereof.

The overcoat layer may contain a photothermal conversion substance to enhance sensitivity. Suitable examples of photothermal conversion substances which may be used in a hydrophilic overcoat layer include the above compounds IR-1 to IR-11.

To ensure good coating uniformity, a nonionic surfactant may primarily be added when the overcoat layer contains a water-soluble resin, and a fluorocarbon surfactant may be added when the overcoat layer is hydrophobic.

To prevent blocking between plates when a plurality of plates are stacked together and stored, the overcoat layer may include the fluorine or silicon atom-containing compounds mentioned in JP 2001-341448 A.

The overcoat layer has a thickness of preferably 0.1 to 4.0 μm, and more preferably 0.1 to 1.0 μm. Within this range, scum of the image recording layer by oleophilic substances can be prevented without compromising the removability of the overcoat layer on the printing press.

Image Recording:

Prior to printing, an image is recorded on the plate by heat. This can be done in a number of different ways, including direct imagewise recording with a thermal recording head or the like, scanning-type exposure using an infrared laser, high-intensity flash-type exposure with a xenon discharge light or the like, and exposure using an infrared lamp. Of these, exposure with a solid high-output infrared laser such as a semiconductor laser or a YAG laser which emits infrared light at a wavelength of 700 to 1200 nm is preferred.

This application claims priority on Japanese patent application No.2003-80103, the contents of which are hereby incorporated by reference. In addition, the contents of literatures cited herein are incorporated by reference.

EXAMPLES

Examples are given below by way of illustration and not by way of limitation.

1. Fabrication of Presensitized Plate (1) Production of Support

An aluminum plate was produced as follows. A melt of JIS A1050 aluminum alloy composed of 99.5 wt % aluminum, 0.10 wt % silicon, 0.30 wt % iron, 0.013 wt % copper and 0.02 wt % titanium, with the balance being inadvertent impurities, was subjected to purification treatment then cast. Purification treatment consisted of degassing treatment to remove unwanted gases such as hydrogen from the melt, followed by ceramic tube filtration. Casting was carried out by a direct chill (DC) casting process. The 500 mm thick solidified ingot was faced, removing 10 mm of material from the surface, then subjected to 10 hours of homogenizing treatment at 550° C. to prevent coarsening of the intermetallic compounds. Next, the ingot was hot rolled at 400° C. and intermediate annealed in a continuous annealing furnace at 500° C. for 60 seconds, then cold rolled to form a rolled aluminum plate having a thickness of 0.30 mm. The centerline average roughness $R_a$ after cold rolling was controlled to 0.2 μm by controlling the roughness of the rolls used in this process. The rolled aluminum was then passed through a tension leveler to improve flatness, and the resulting aluminum plate was-surface treated as described below.

First, to remove rolling oils from the surface of the aluminum plate, degreasing treatment was carried out at 50° C. for 30 seconds using a 10 wt % aqueous solution of sodium aluminate. Neutralization and desmutting were then carried out with 30 wt % aqueous sulfuric acid at 50° C. for 30 seconds.

Next, graining treatment was administered to improve adhesion between the image recording layer and the support and to confer the non-image areas with water-retaining properties. Specifically, electrochemical graining treatment was carried out by an electrolytic process that consisted of passing the aluminum plate web through an aqueous solution (solution temperature, 45° C.) which contains 1 wt % nitric acid and 0.5 wt % aluminum nitrate and is supplied to an indirect current supply cell, while at the same time applying 240 C/dm$^2$ of electricity to the aluminum plate as the anode at a current density of 20 A/dm$^2$ and as an alternating waveform having a duty ratio of 1/1.

Moreover, etching treatment was carried out using a 10 wt % aqueous solution of sodium aluminate at 50° C. for 30 seconds, following which neutralization and desmutting were administered using 30 wt % aqueous sulfuric acid at 50° C. for 30 seconds.

Anodizing treatment was then carried out to improve the wear resistance, chemical resistance and water retention. This consisted of administering electrolytic treatment to the aluminum plate web with direct current at a current density of 14 A/dm$^2$ while passing the web through 20 wt % aqueous sulfuric acid (solution temperature, 35° C.) supplied to an indirect current supply cell, thereby forming on the aluminum plate a 2.5 g/m$^2$ anodized layer.

Next, to ensure the hydrophilic properties of non-image areas, the aluminum plate was silicate-treated using a 1.5 wt % aqueous solution of No. 3 sodium silicate at 70° C. for 15 seconds. The amount of silicon deposited was 10 mg/m$^2$. The treated plate was then rinsed with water, giving the finished support. The support thus obtained had a centerline average roughness $R_a$ of 0.25 μm.

(2) Formation of Image Recording Layer

An image recording layer-forming coating liquid of the following composition was bar coated onto the support obtained as described above, then dried in an oven at 70° C. for 120 seconds to form an image recording layer (coating weight after drying, 1.0 g/m$^2$), thereby giving a finished PS plate.

<Composition of Image Recording Layer-Forming Coating Liquid>

| | |
|---|---|
| Water | 35.4 g |
| Microcapsule liquid (described below) | 9.0 g |
| Acid precursor having above formula AI-7 | 0.24 g |
| Fluorocarbon surfactant (Megaface F-171; made by Dainippon Ink And Chemicals, Incorporated) | 0.05 g |

<Microcapsule Liquid>

An oil phase component was prepared by dissolving the following in 18.4 g of ethyl acetate: 3 g of the bis(vinyloxyethyl)ether of bisphenol A, 5 g of trimethylolpropane-xylylene diisocyanate adduct (Takenate D-110N, a microcapsule wall material produced by Mitsui Takeda Chemicals, Inc.), 3.75 g of an aromatic isocyanate oligomer (Millionate MR-200, a microcapsule wall material produced by Nippon Polyurethane Industry Co., Ltd.), 1.5 g of the infrared absorbing dye having above formula IR-27, 0.5 g of 3-(N,N-diethylamino)-6-methyl-7-anilinofluoran (ODB, made by Yamamoto Chemicals, Inc.), 1 g of tricresylphosphate (Tokyo Kasei Co., Ltd.) and 0.1 g of surfactant (Pionin A41C, made by Takemoto Oil & Fat Co., Ltd.). An aqueous phase component was obtained by preparing 37.5 g of an aqueous solution containing 4 wt % of polyvinyl alcohol (PVA-205, made by Kuraray Co., Ltd.).

The oil phase component and aqueous phase component were emulsified using a homogenizer at 12,000 rpm for 10 minutes. An aqueous solution of 0.38 g of tetraethylenepentamine (a microcapsule wall crosslinking agent that is a pentaamine) in 26 g of water was added to the resulting emulsion, following which the mixture was stirred under water cooling for 30 minutes, then additionally stirred at 65° C. for 3 hours to give a microcapsule liquid.

The resulting microcapsule liquid had a solids concentration of 24 wt % and an average particle size of 0.3 μm.

2. Printing Test

The resulting PS plate was exposed using a Trendsetter 3244 VX (Creo Inc.) equipped with a water-cooled 40 W infrared semiconductor laser at an output of 17 W, an external drum speed of 150 rpm and a resolution of 2,400 dpi, thereby recording an image. Printing was then carried out using the printing press 10 shown in FIG. 1. Geos-G Magenta (Dainippon Ink And Chemicals, Incorporated) was used as the ink after adding 10 wt % of varnish (Fine Varnish, produced by Dainippon Ink And Chemicals, Incorporated) to create harsh conditions under which scum readily occurs. The dampening water used was prepared by adding 1 wt % of EU3 (Fuji Photo Film Co., Ltd.) and 5 wt % of IPA to water.

First, the plate on which the image had been recorded was mounted on the plate cylinder 16, and the plate cylinder 16 was driven at a speed of 3,000 revolutions per hour. The dampening roller 27 having a given surface speed was then brought into contact with the plate on the plate cylinder 16. Next, following contact by the dampening roller 27, the plate cylinder 16 revolved ten times, after which the form rollers 18 having a given surface speed were brought into contact with the plate. After contact by the form rollers 18, the plate cylinder 16 revolved ten times, following which coated paper was fed as the printing material and printing was begun.

At about the same time as printing began, the surface speeds of the dampening roller 27 and the form rollers 18 were changed to substantially the same speed as the surface speed of the plate, and the plate cylinder speed was increased to 10,000 revolutions per hour. A total of 50,000 sheets were printed in this state.

The surface speeds of the dampening roller 27 and the form rollers 18 following the start of printing were made substantially the same as the surface speed of the plate cylinder at all times. Moreover, the two form rollers 18 were set at the same surface speed at all times.

Printing was carried in the manner described above, but at various surface speed differences between the plate and the dampening roller 27 and form rollers 18, based on the plate surface speed prior to the start of printing (development step), as shown in Table 1. Moreover, the plate was replaced with a new plate each time the surface speed difference was changed.

3. Evaluation

The number of impressions required from the start of printing to eliminate scum in non-image areas ("sheets required to eliminate scum") and the number of impressions from the start of printing until image defects were observed in image areas ("press life") were evaluated.

The results are shown in Table 1.

TABLE 1

| Surface speed difference between plate and dampening roller/ink rollers (%) | −60 | −50 | −30 | −20 | −10 | −5 | −2 | 0 | 2 | 5 | 10 | 20 | 30 | 50 | 60 |
|---|---|---|---|---|---|---|---|---|---|---|---|---|---|---|---|
| Sheets required to eliminate scum | Exc | Exc | Exc | Exc | Exc | Good | Fair | Poor | Fair | Good | Exc | Exc | Exc | Exc | Exc |
| Press life | Poor | Fair | Good | Exc | Exc | Exc | Exc | Exc | Exc | Exc | Exc | Exc | Good | Fair | Poor |

The ratings in the table are described below.

Sheets required to eliminate scum:

| | |
|---|---|
| Excellent (Exc): | 1 to 5 sheets |
| Good: | 6 to 10 sheets |
| Fair: | 11 to 20 sheets |
| Poor: | 21 sheets or more |

Press life:

| | |
|---|---|
| Excellent (Exc): | 30,000 sheets or more |
| Good: | at least 10,000 but less than 30,000 sheets |
| Fair: | at least 5,000 but less than 10,000 sheets |
| Poor: | less than 5,000 sheets |

As is apparent from Table 1, in the development step, by having the surface speeds of the dampening roller and the form rollers differ from the surface speed of the plate, developability improved and the number of sheets required to eliminate scum decreased. In addition, as the surface speed difference between the plate on the plate cylinder and the dampening roller and form rollers became larger, the number of sheets required to eliminate scum decreased.

At the same time, as the surface speed difference between the plate on the plate cylinder and the dampening roller and form rollers became larger, the press life decreased. This is because a large difference in surface speed during the development step gave rise to excessive development, leading to wear of the image recording layer.

As a result of this printing test, the surface speed difference between the plate and the dampening roller (form rollers) at which it is possible to both eliminate scum using a small number of impressions and to achieve a long press life was found to be preferably within a range of −2 to −50% and 2 to 50%, more preferably within a range of −5 to −30% and 5 to 30%, and most preferably within a range of −10 to −20% and 10 to 20%. By setting the surface speed difference within a range of −10 to −20% and 10 to 20% in particular, both of these properties (number of sheets required to eliminate scum, and press life) can be achieved to a very high level.

What is claimed is:

1. A method of carrying out lithographic printing using a plate having an image recording layer capable of being developed with dampening water and/or ink, the method including:

a development step in which a plate bearing a recorded image, mounted on a plate cylinder and having a given surface speed is subjected to contact with a dampening roller and/or a form roller having a surface speed differing from the surface speed of the plate, and is thereby supplied with dampening water and/or ink; and a printing step in which ink is transferred to a printing material while the dampening roller and form roller remain in contact with the plate, wherein the surface speed of the dampening roller in the development step differs from the surface speed of the dampening roller in the printing step.

2. A method of carrying out lithographic printing using a plate having an image recording layer capable of being developed with dampening water and/or ink, the method including:

a development step in which a plate bearing a recorded image, mounted on a plate cylinder and having a given surface speed is subjected to contact with a dampening roller and/or a form roller having a surface speed differing from the surface speed of the plate, and is thereby supplied with dampening water and/or ink; and a printing step in which ink is transferred to a printing material while the dampening roller and form roller remain in contact with the plate, wherein the surface speed of the form roller in the development step differs from the surface speed of the form roller in the printing step.

3. A method of carrying out lithographic printing using a plate having an image recording layer capable of being developed with dampening water and/or ink, the method including:

a development step in which a plate bearing a recorded image, mounted on a plate cylinder and having a given surface speed is subjected to contact with a dampening roller and/or a form roller having a surface speed differing from the surface speed of the plate, and is thereby supplied with dampening water and/or ink; and a printing step in which ink is transferred to a printing material while the dampening roller and form roller remain in contact with the plate, wherein the surface speed of the dampening roller in the development step differs from the surface speed of the dampening roller in the printing step and the surface speed of the form roller in the development step differs from the surface speed of the form roller in the printing step.

* * * * *